US006027411A

United States Patent [19]

Hühne

[11] Patent Number: 6,027,411

[45] Date of Patent: Feb. 22, 2000

[54] AUTOMATIC BOWLING PIN SETTER OR SKITTLE SETTER MACHINE

[76] Inventor: Siegmar Hühne, 46487 Wesel, Waldstr. 17a, Germany

[21] Appl. No.: 08/888,214

[22] Filed: Jul. 3, 1997

[51] Int. Cl.[7] ..... A63D 5/08

[52] U.S. Cl. ..... 473/73; 473/87; 473/90; 473/57

[58] Field of Search ..... 473/57, 73, 86, 473/87, 89, 90, 91, 94, 95, 96, 97

[56] References Cited

U.S. PATENT DOCUMENTS

| | | | |
|---|---|---|---|
| 1,573,643 | 2/1926 | Proch . | |
| 2,817,528 | 12/1957 | Sanford | 273/42 |
| 2,853,300 | 9/1958 | Montooth et al. | 473/96 |
| 2,887,318 | 5/1959 | Whipple et al. | 273/43 |
| 2,902,281 | 9/1959 | Scherzinger | 273/43 |
| 2,977,121 | 3/1961 | Flint et al. | 473/73 |
| 3,041,072 | 6/1962 | Dowd et al. | 473/73 |
| 3,123,201 | 3/1964 | Dowd et al. | 473/96 |
| 3,123,357 | 3/1964 | Dowd et al. | 473/87 |
| 3,191,934 | 6/1965 | Kalbfleisch | 473/95 |

FOREIGN PATENT DOCUMENTS 2322950 5/1973 Germany .

*Primary Examiner*—William M. Pierce
*Attorney, Agent, or Firm*—Wm. Bruce Day

[57] ABSTRACT

An automatic bowling pin setting machine includes a sorting section receiving knocked down pins and bowling balls, an elevator conveying pins to a receiving reel, and a setting reel to which pins drop downwardly from the setting reel. Gripper arms accompanying the setting reel pick up any standing pins to ready the alley for a second throw. After a second throw, the alley is swept clean of pins, and the setting reel places a new set of pins in the alley. The setting machine is designed with reduced maintenance in mind and for sureness of operation.

3 Claims, 25 Drawing Sheets

Fig. 6
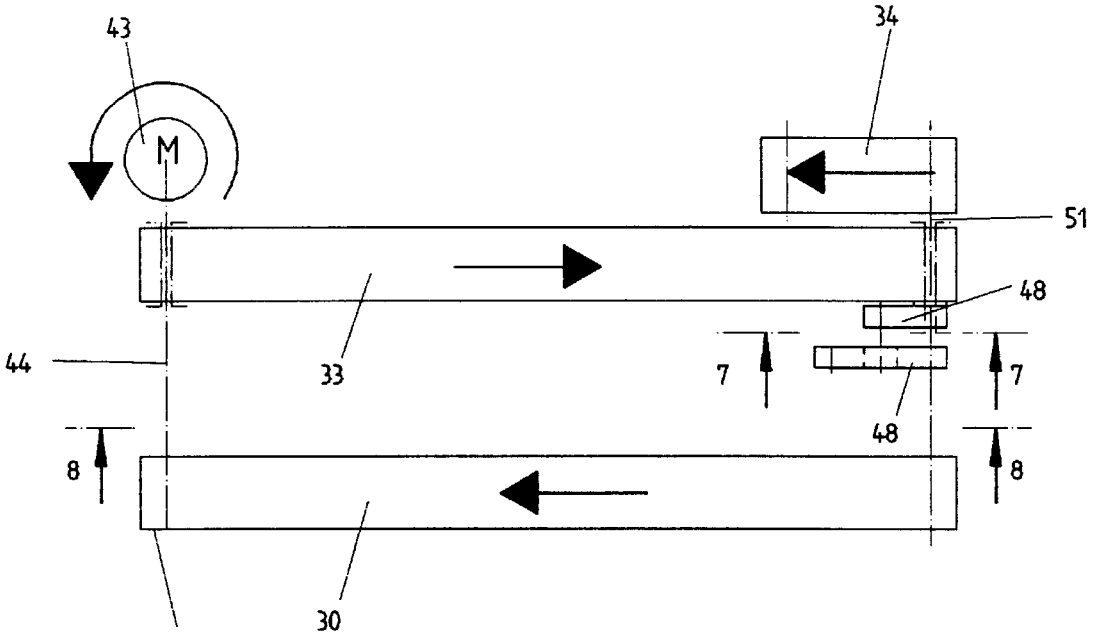
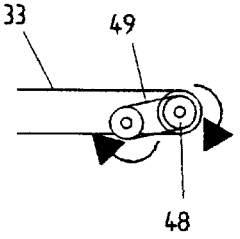
Fig. 8
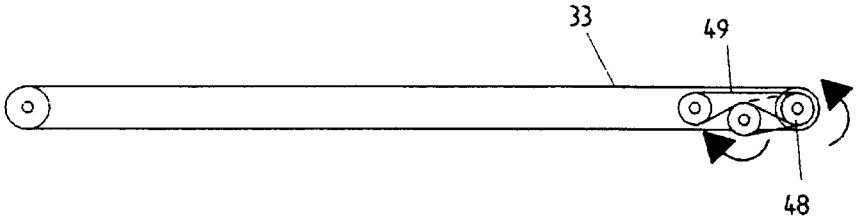

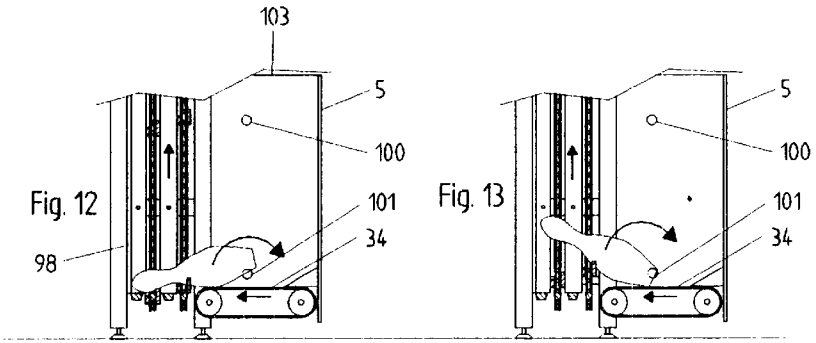
Fig. 12
Fig. 13
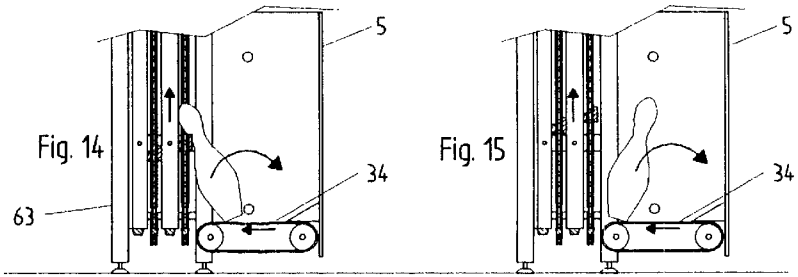
Fig. 14
Fig. 15
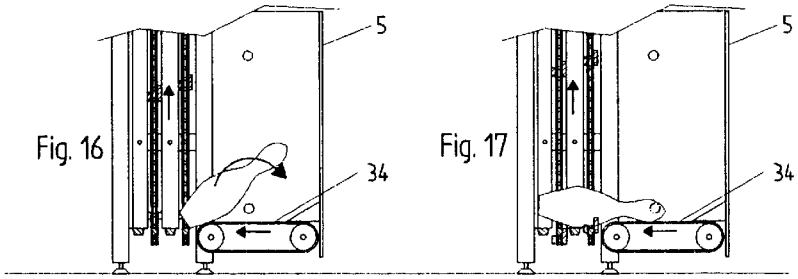
Fig. 16
Fig. 17
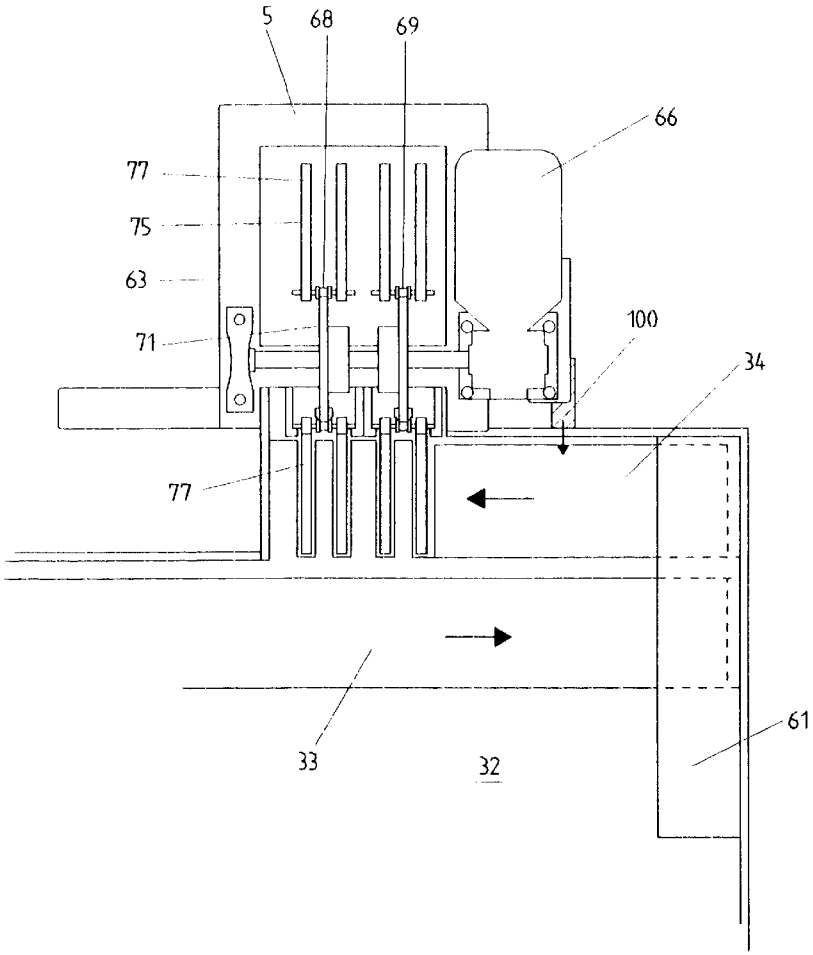
Fig. 11

AUTOMATIC BOWLING PIN SETTER OR SKITTLE SETTER MACHINE

FIELD OF THE INVENTION

This invention relates to an automatic bowling pin setter or skittle setter machine for a bowling or skittle facility.

BACKGROUND OF THE INVENTION

A bowling pin setter or skittle setter machine which takes the pins remaining standing after a throw, lifts them off the alley and resets the pins after the knocked down pins have been removed is known from U.S. Pat. No. 2,887,318. This machine includes a clearing device, a vertical conveyor, a pin divider, as well as a pin holding and setting unit. The mechanics of the prior setting machine are technically complex to use. The failure of only one unit within the prior pin setting machine can cause the entire system of the bowling alley to break down which, because of the complexity of the machinery, can only be repaired by costly and extensive maintenance by experts. Further, these systems are expensive for the facility to install and maintain. A further disadvantage is that it is not possible for the setting machine disclosed in the '318 patent to create varied selective pin settings on the alley.

A skittle setting machine disclosed in German Patent DE2322950 is likewise technically complex. For example, the pins travel from a diagonal chute into revolving catch holders in a divided wheel and then swing further downwardly into an alignment rack. The nearly simultaneous rotation of all of the holders is mechanically complex, and unintended rotation of one or some of the catch holders can be unsafe for the mechanic. A further disadvantage is that if the catch receptacles and the rack do not align, the pins remaining after a throw of the ball will not be picked up and set down properly, but only centered in the catch receptacle.

OBJECTS OF THE INVENTION

The object of the invention is to provide an automatic bowling or skittle pin setter machine which is economically manufactured and reduces the necessity for spare parts and repair and maintenance costs as much as possible. An object also is to provide such a machine for which after a throw of the ball, pins remaining in displaced but standing positions can be picked up and reset precisely after the fallen pins have been cleared.

In addition, an object is to provide an automatic bowling or skittle pin setter machine in which it is possible to select a variety of pin or skittle settings on the alley.

A further advantage of the invention is that it uses a simple construction of individual elements which makes possible different functions of the pin or skittle setter machine. Thus, expenses for the introduction of new modes of operation are minimized by, for example, changes in programming of a controller and/or slight changes in mechanical parts.

It should also be understood that components in the course of further development of this machine can be made without affecting the principle of the entire machine or the concept of the invention.

Further, the present invention improves maintenance and control on a pin setting machine and improves reliability of operation.

DESCRIPTION OF THE DRAWINGS

FIG. 6 is a diagrammatic, plan view of the ball conveyor.

FIG. 7 is a sectional view taken along lines 7—7, FIG. 6.

FIG. 8 is a longitudinal sectional view taken along lines 8—8, FIG. 6.

FIG. 11 is a fragmentary, plan view of a pin positioning and orientation arrangement.

FIG. 12 is a fragmentary view showing operation of the pin orientation and lifting arrangement.

FIG. 13 is a fragmentary view showing operation of the pin orientation and lifting arrangement.

FIG. 14 is a fragmentary view showing operation of the pin orientation and lifting arrangement.

FIG. 15 is a fragmentary view showing operation of the pin orientation and lifting arrangement.

FIG. 16 is a fragmentary view showing operation of the pin orientation and lifting arrangement.

FIG. 17 is a fragmentary view showing operation of the pin orientation and lifting arrangement.

DESCRIPTION OF THE PREFERRED EMBODIMENT

As required detailed embodiments of the invention are described and shown herein. However, the invention may embody various forms and is not to be limited to that of the following description.

Figure 1:
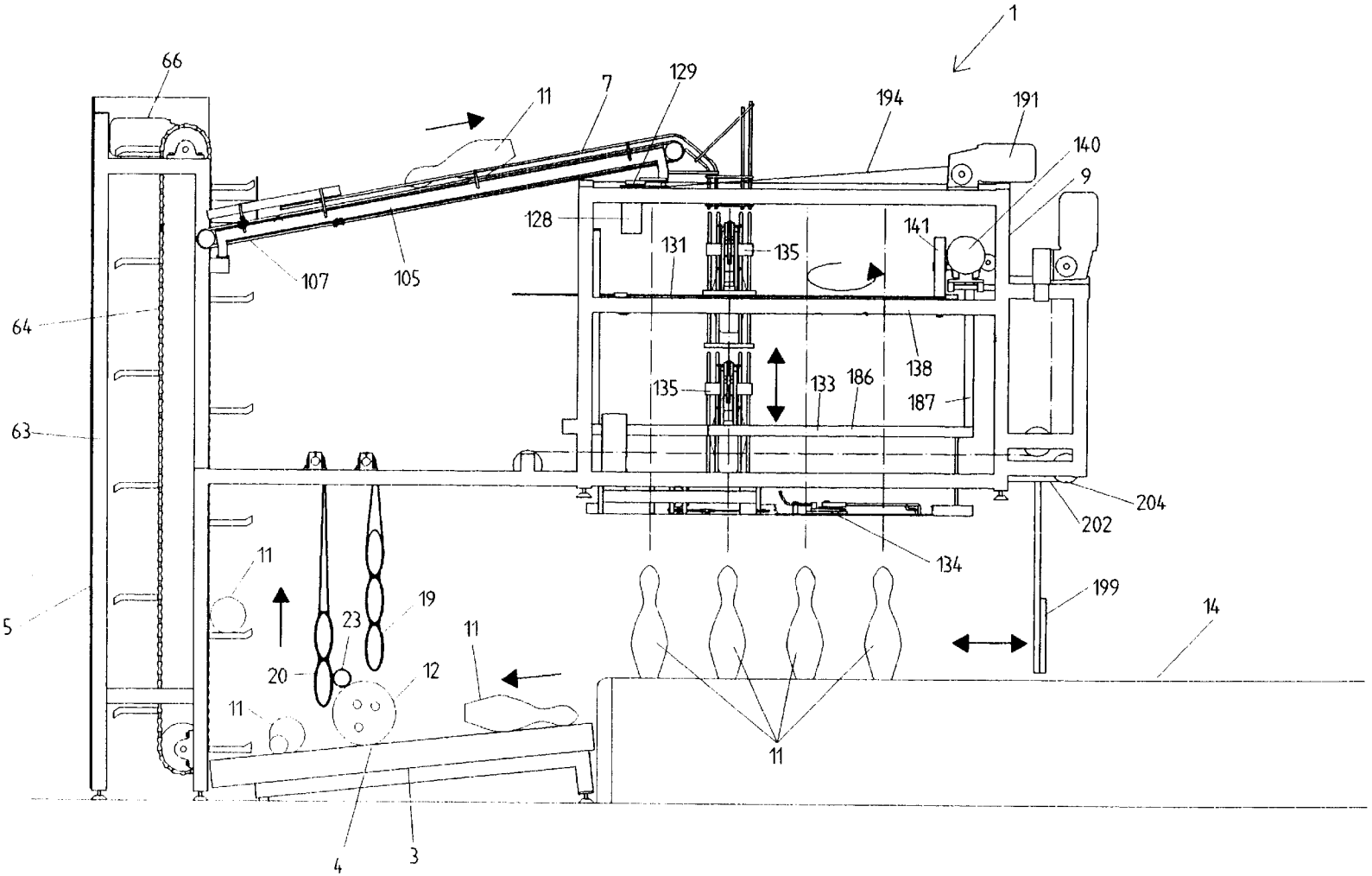
FIG. 1 is an elevational side view of the automatic pin setting machine.

The reference numeral 1, FIG. 1, generally designates a pin setter in accordance with the applicant's invention. In general arrangement, the pin setter 1 includes a pin receiving section 3 with a ball return 4, an upward elevator section 5, a lateral transfer conveyor 7 extending from the top of the elevator section 5 and a pin setting mechanism 9. In operation, the pin setter 1 receives pins 11 and balls 12 from a set-up on a bowling alley 14, which fall into the pin receiving section 3 after a ball 12 strikes down pins 11 standing in their proper places on the alley 14. From the pin receiving section 3, the balls 12 are returned through the ball return 4 to ball return lanes (not shown) in the bowling alley. The pins 11 gather at the elevator section 5, are oriented, and lifted vertically to the transfer conveyor 7 where they are transported base first to the pin setting mechanism 9. In the pin setting mechanism 9, as will be hereinafter explained, the pins 11 are inserted into various stages of pin holding mechanisms which then drop down to the level of the alley 14 to selectively deposit pins on the alley in the appropriate pattern.

Referring to the drawings in more detail, the pins 11 on the alley 14 normally have the familiar ten pin bowling arrangement. It will be appreciated after the bowler rolls the ball 12, some of the pins 11 may be knocked down and into the pin receiving section 3 whereas other pins 11 may be missed and left standing. As will be hereinafter described, the pin setter 1 is capable of lifting those pins 11 which are left standing after a first roll of the ball and sweeping the alley 14 clear after raising the pins 11 and then subsequently depositing a full set of pins 11 in the appropriate arrangement on the alley 14.

Figure 3:
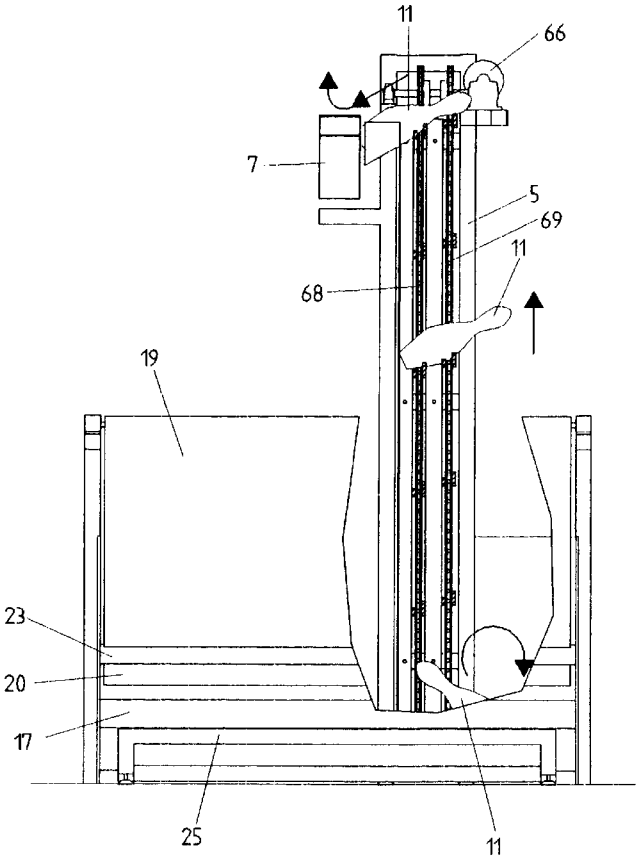
FIG. 3 is a front elevational view showing the ball and pin separator and the pin elevator.
Figure 2:
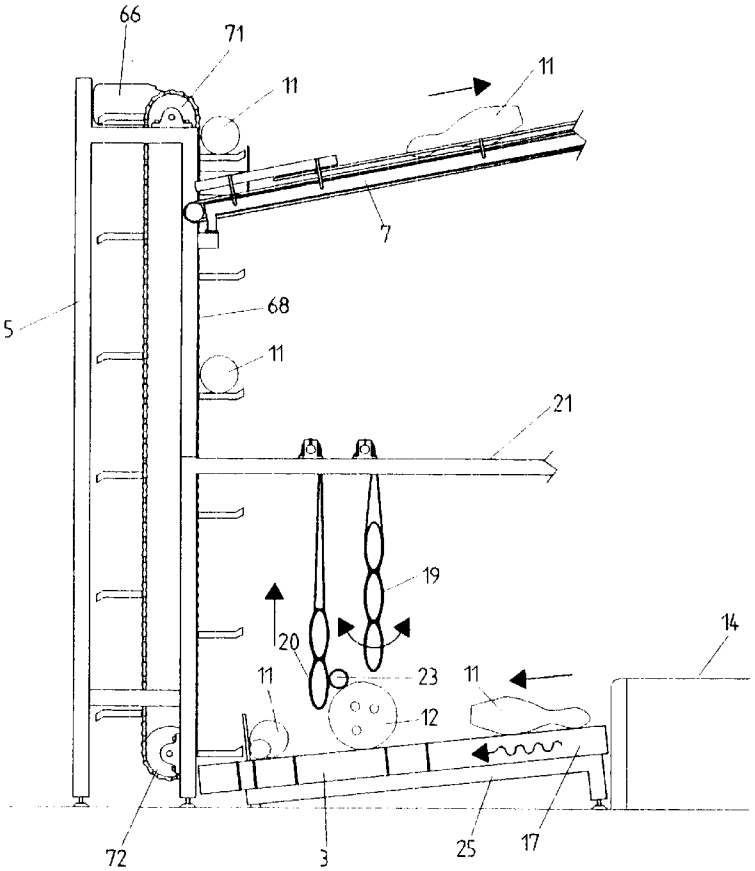
FIG. 2 is a side elevational view showing a portion of the automatic pin setting machine, which portion comprises a ball and pin sorting arrangement and a vertical pin elevator.

Regardless of the number of pins received in the pin receiving section 3, the operation is the same. The pin receiving section 3, FIGS. 2–11, includes an inclined vibrating platform 17. The platform moves the pins 11 downwardly toward the receiving portion of the elevator section 5 as will hereinafter be explained. Within the pin receiving section 5, front and rear sandbag curtains 19 and 20 hang downwardly from a support bar 21 and knock down any pins 11 that may fly through the air after being struck by a ball on the alley 14. A bar 23 extends transversely across the vibrating platform 17 and serves to catch any balls 12 that rolled down upon the platform 17. The platform 17, FIGS. 2 and 3, is supported on a framework base 25 so that it inclines toward the base of the elevator section 5 at approximately a 7–10° slope. The inclined vibrating platform 17 is generally composed of five sections including a front vibrator plate 27, a first conveyor 30, a pipe section 32, a second conveyor 33 and a third conveyor 34.

Figure 4:
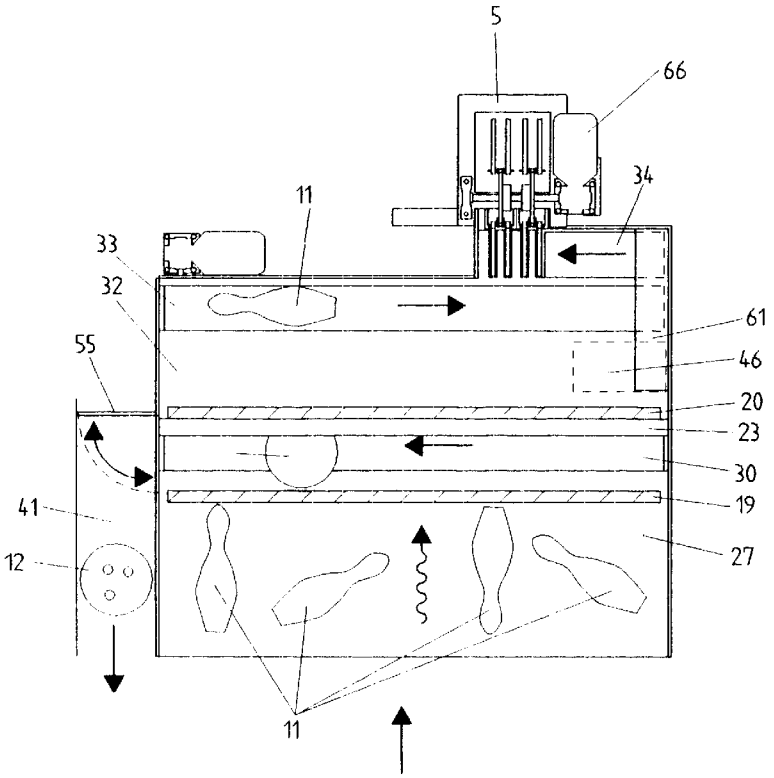
FIG. 4 is a plan view of a portion of the automatic pin setting machine showing the pin and ball sorting arrangement and the pin elevator.
Figure 9:
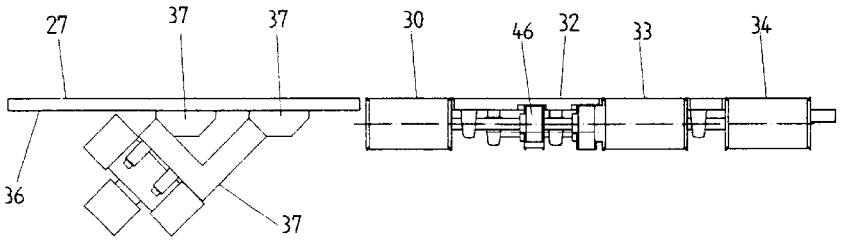
FIG. 9 is a fragmentary and elevational view of the ball and pin conveyor sorting device.
Figure 10:
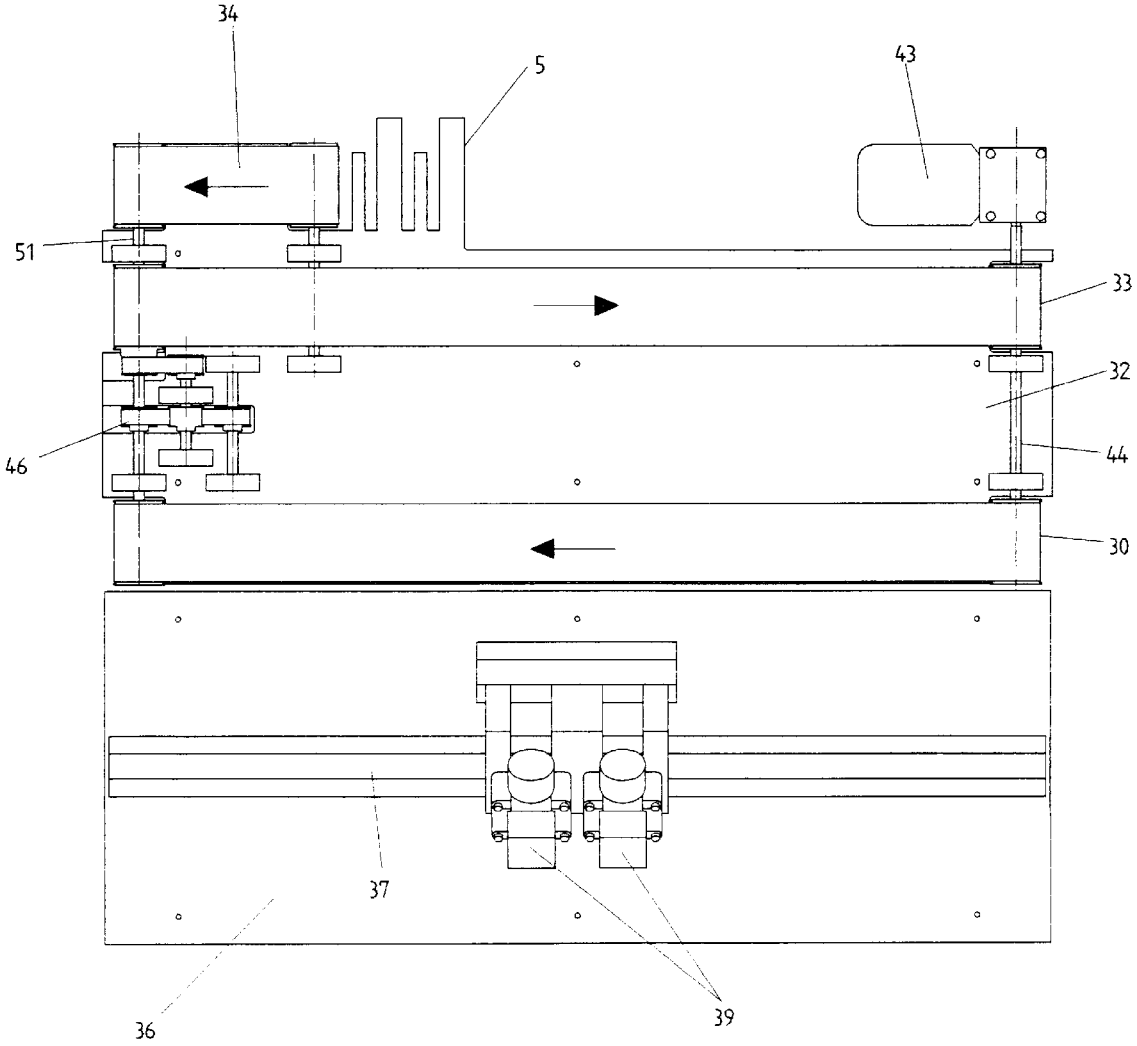
FIG. 10 is a bottom view of the ball and pin conveyor sorting device.

The vibrator plate 27 assures that the balls and pins will roll rearwardly and is formed of a plate 36, FIG. 10, underlain by support bars 37. FIG. 10 is a bottom view of the pin receiving section 3 and shows the support bars 37 and counter rotating vibrator motors 39. The vibrator motors 39 are electric and include eccentric weights which synchronize during operation. The vibrator motors 39 cause the plate 36 to vibrate and move the pins 11 rolling rearwardly. From the vibrator plate 27, the pins and balls move to the first conveyor 30. The first conveyor 30 moves pins and balls left laterally of the pin receiving section 3 as shown in FIG. 4 so that the ball 12 can be removed and returned to the players' positions at the front of the bowling alley via a ball return channel 41. The first conveyor 30 is a flexible belt conveyor which is flat and is driven by a single drive motor 43 which drives all the conveyors including the first conveyor 30, the second conveyor 33 and the third conveyor 34. The drive motor 43 operates through a common drive shaft 44 to power the first and second conveyers 30 and 33 and the third conveyor 34 is driven off of the second conveyor 33. FIGS. 6, 7 and 8 show the orientation of the conveyors as pertains to the drive motor 43 and the drive shaft 44. The conveyors are preferably all driven at a one-to-one ratio and a direction change mechanism is shown at 46, FIG. 10, with the principal of operation shown in connection with FIG. 8. The direction change mechanism 46 includes a plurality of pulleys 48 and interconnected belts 49 arranged so as to cause the belt 30 to drive in one direction and the belt 33 to drive in the opposite direction. The pulley or the conveyor 34 is driven via a shaft 51 extending from the first conveyor 30 so that it travels in the same direction as the belt 30 and in an opposite direction to the conveyor 33.

Figure 20:
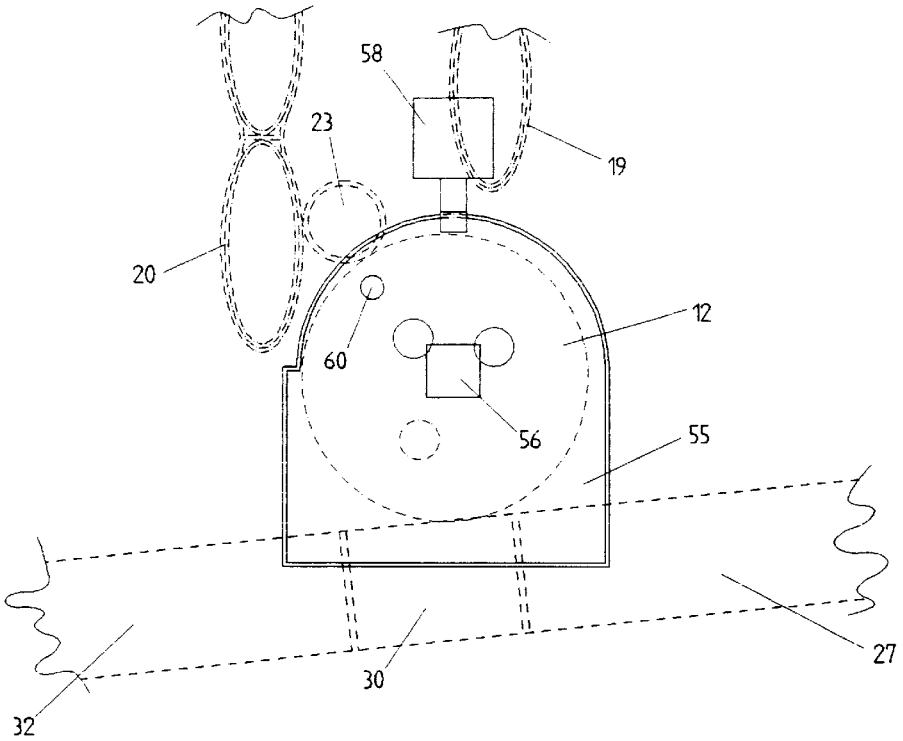
FIG. 20 is a side elevational view portion of the pin and ball receiving area and showing a ball door exit.
Figure 21:
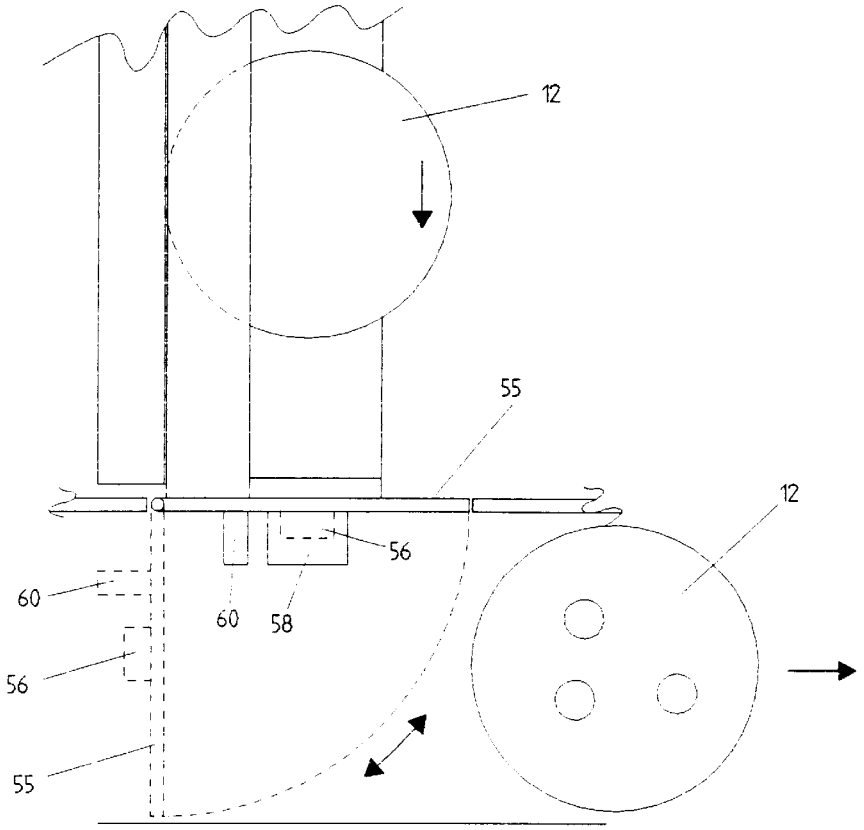
FIG. 21 is a fragmentary, plan view of the ball door exit area.

Adjacent the conveyer 30 at its travel end 53 is a door 55, FIG. 20, which opens to the position shown in FIG. 4. On the door 55 is a contact switch 56 which senses the impact of the ball 12 and generally opens the door 55 through a solenoid operated latch mechanism 58. An electronic eye 60 is generally located at the door 55 to sense the position of the ball 12 so as to distinguish the ball from pins 11. For example, if a pin is brought against the door 55 by the conveyor 30 with the ball behind the pin, because although the electronic eye 60 sees the ball, the contact switch 56 is not touched. In the event of this occurrence, the contact switch 56 is routed through a controller as will be hereinafter described which activates a timer within the controller. Normally, immediately after the switch 60 senses a ball, switch 56 is engaged and activates the latch release mechanism 58. In the event that too long a period of time occurs between actuation of switches 60 and 56, a signal is sent from the controller to the conveyor drive motor 43 to reverse its direction of rotation, in which case all the conveyors 30, 33 and 34 reverse to clear out the pin that is stuck between the ball and the door 55.

Figure 5:
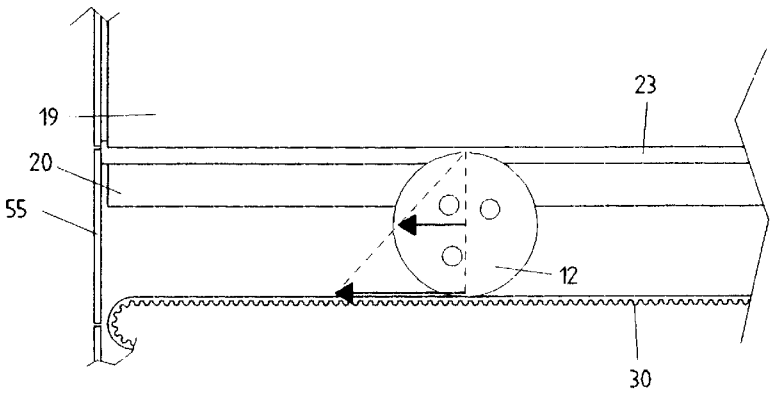
FIG. 5 is an enlarged fragmentary view of the ball and pin sorting arrangement showing a ball conveyor.

Additionally, as shown in FIG. 5, the ball 12 engages against the cross bar 23 so that it does not roll without movement on the conveyor 30. The speed of travel of the ball on the conveyor 30 is approximately one half that of the speed of travel of the conveyor 30.

From the conveyor 30, pins pass over the conveyor and roll downwardly on the pipe section 32 and are transported in the direction shown by the arrows on FIG. 4 to the opposite wall of the pin receiving section 3. At the wall is an inclined stop plate 61 at an approximately 45° angle. The inclined stop plate 61 prevents the pin from getting stuck as it rolls onto the third conveyor 34. The third conveyor 34 leads into the elevator section 5.

Figure 18:
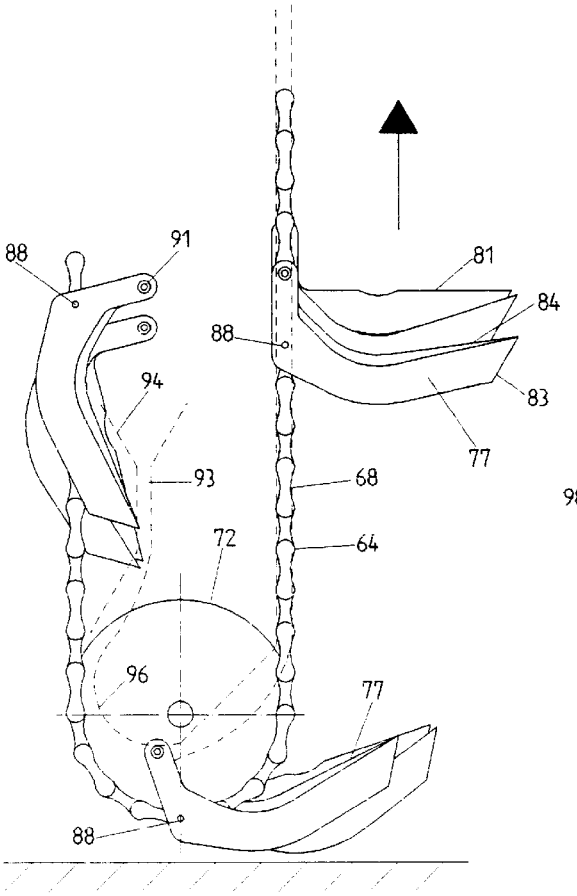
FIG. 18 is a fragmentary, side elevational view showing a pin lifting conveyor.
Figure 19:
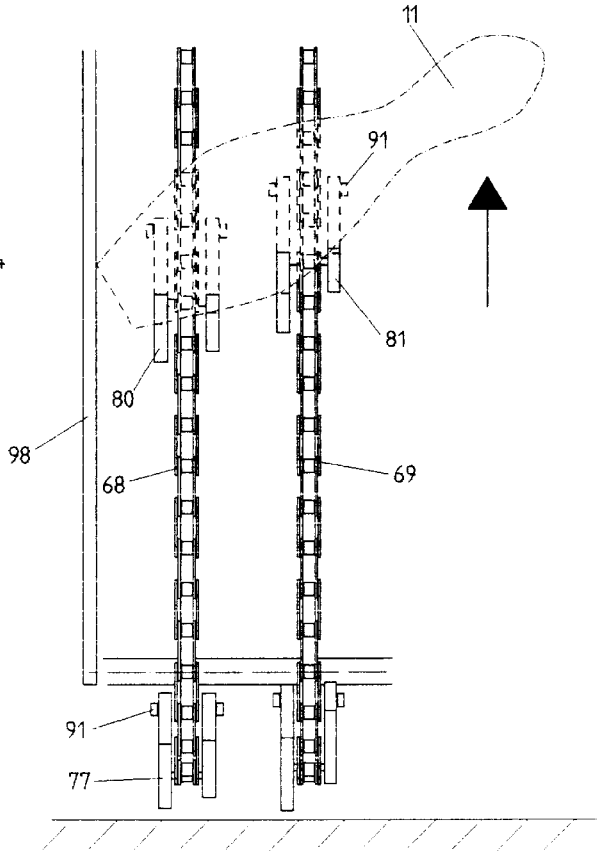
FIG. 19 is a fragmentary, side elevational view showing a pin lifting conveyor.

The elevator section 5 returns pins 11 from the pin receiving section 3 to the pin setting mechanism 9. Generally, the elevator section 5 includes a vertical framework 63 which carries a chain conveyor 64 driven at an upper end by a motor drive unit 66. The chain conveyor 64 is in fact composed of first and second conveyors chains 68 and 69 and extend about upper and lower pulleys 71 and 72. The conveyor chains 68 and 69 carry pin supporting arms 75 which are four in number to compose a single pin support cradle 77. Each of the pin support arms 75 is shown in FIGS. 18 and 19 which have an extension and curvature generally as shown. Generally they are upwardly curved and are mounted in pairs of two about each of the conveyor chains 68 and 69. Each pair will form a first pair 80, FIG. 19, which is spaced lower on the chain 68 than a second pair 81 mounted on the chain 69. Because of the shape of the bowling pin 11, each of the support arms 75 has a somewhat different shape and includes first arm 83, second arm 84, third arm 85 and a fourth arm 86. The pin support arms 75 are hingedly mounted to the chains 68 and 69 as by pivot pins 88, an arm extension 90 extending generally perpendicularly to each arm 75 and terminates in guide pins 91. The pin support arms 75 rotate on the pivot pins 88 from a downwardly extending non-cradling position to an outwardly extending cradling position as shown in FIG. 18. To cause this effect, the guide pins 91 mounted on the arm extensions 90 of each of the arms 75 travel within a guide channel 93 formed in or mounted in the vertical framework 63. The guide channel 93 has an upward opening 94 and a sinuous portion 96 which is designed for minimal floor space between the bottom end of the conveyor and the floor surface. On its upward return, the guide chains 68 and 69 travel in or against the guide channel 93 which at this point forms a relatively narrow channel in order to hold the pin support cradles 77 fully outwardly extended and in position to retrieve a pin 11. It is generally necessary that the pin support cradle 77 have the arms fully extended outwardly as shown in FIG. 18 as it picks up the pins otherwise the bowling pin may be pushed outwardly and not positioned to be raised vertically. The pin support cradles 77 receive the pins 11 from the third conveyor 34. It will be appreciated that a plurality of pin support cradles 77 are positioned on the conveyor chain 68 and 69 at intervals so as to be able to lift a plurality of pins 11 simultaneously.

As shown in FIGS. 12–17, the pins 11 are delivered to the rising pin support cradle 77 via the third conveyor 34. The pins must be raised base first from the end of the third conveyor 34, as shown in FIG. 17, to be able to be properly position for further handling. If a pin approaches head end first, as shown in FIG. 12, as the higher position arms of the pin support cradle 77 engage the neck portion of the pin, as shown in FIG. 12, the pin is flipped over, as shown in FIG. 13. The pin continues to rotate, FIGS. 14 and 15, to the position shown in FIG. 16 whereupon the conveyor 34 pushes the pin 11 to the position shown in FIG. 17 whereby the pin is properly positioned in the pin support cradle 77 for raising. The head of the pin 11, as shown in FIG. 12, hits against a vertical wall 98 which stops the travel of the pin and aids in causing the pin 11 to flip over to the position shown in FIG. 17. Photoelectric cells 100 and 101 located in a back wall 103 of the vertical framework 63, sense blockages above the third conveyor 34. The photoelectric cells 100 and 101 are timed through a central controller. The lower controller 101 provides a signal to a timer which is reset by the upper photoelectric cell 100 as the pin 11 is carried upwardly. If the timer is not reset, it indicates a blockage in the lower portion and a signal is sent to the conveyor motor to reverse direction for a predetermined period of time in order to clear any blockage on the third conveyor 34.

At the top of the elevator section 5, the pins 11 are transferred to the transfer conveyor 7, FIG. 1. The transfer conveyor 7 includes a support frame 105 and is mounted at its entry end 107 sidewardly of the elevator section 5. Specifically, a side wall 98 of the elevator section 5 terminates so that the pin 11 slides downwardly and onto the conveyor, turning sidewardly as it occurs.

Figure 22:
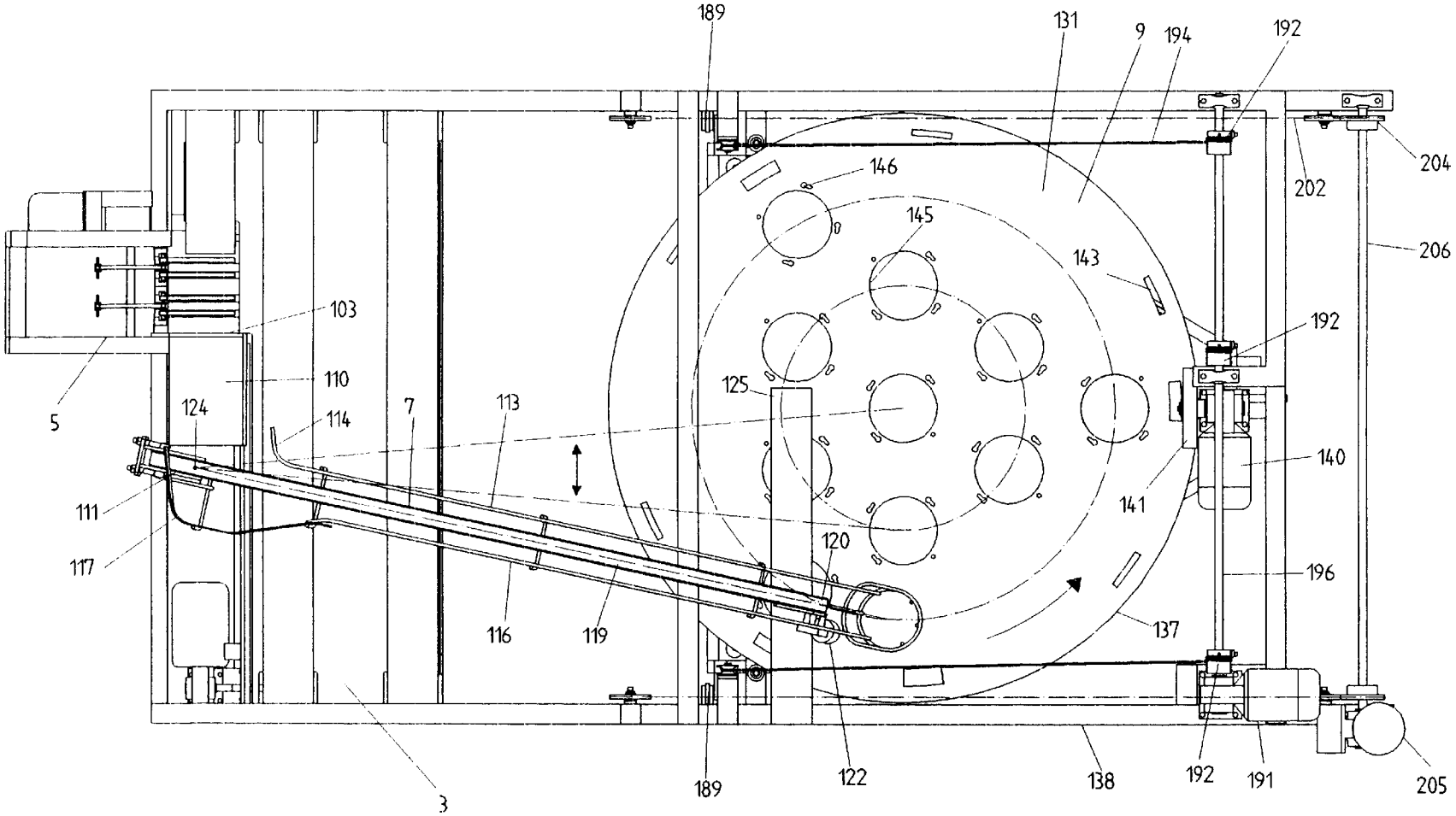
FIG. 22 is a top plan view of pin holding mechanism.
Figure 23:
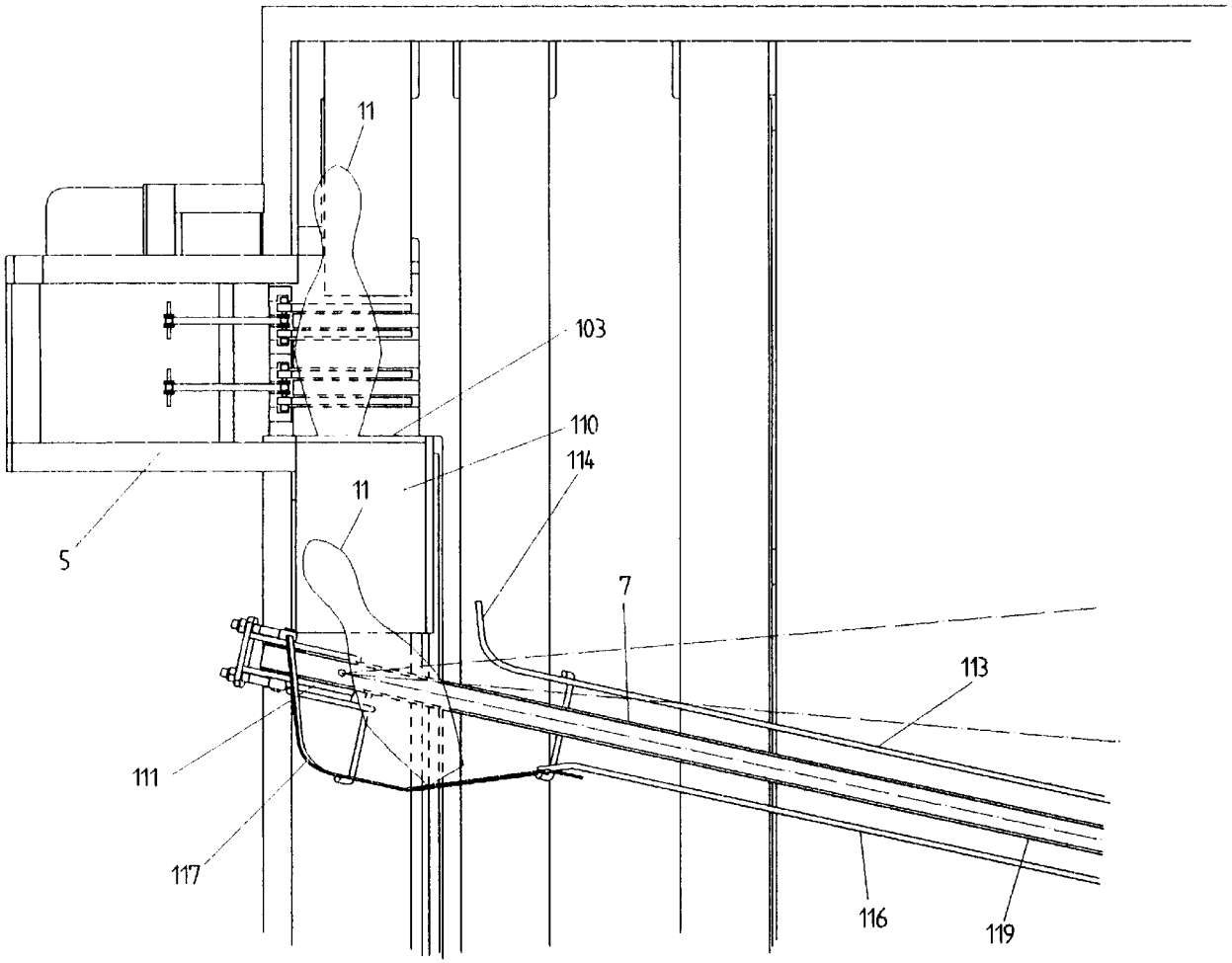
FIG. 23 is a longitudinal sectional view of the pin holding apparatus.
Figure 24:
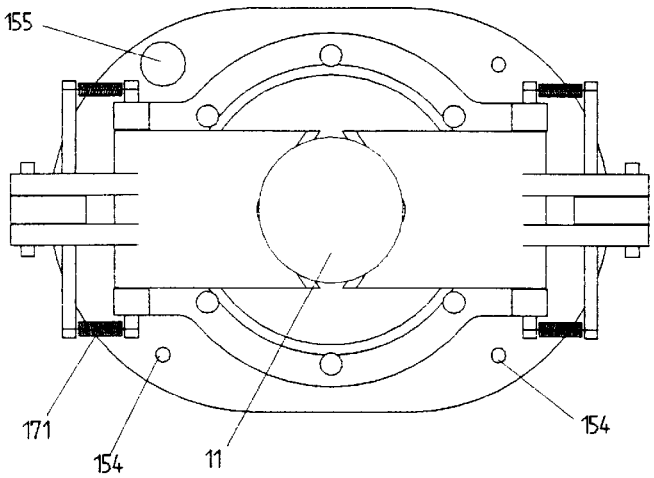
FIG. 24 is a longitudinal sectional view of the pin holding apparatus.

FIG. 22 is a plan view of the overall arrangement shown in FIG. 1. The transfer conveyor 7 is shown in FIG. 22 and in FIG. 23, which is a detail of a portion of the elevator section 5 and the transfer conveyor 7. As the pins 11 reach the top of the elevator section 5, the pins 11 have been sliding against a vertical back wall 103 and at the top reach the termination of the back wall 103, whereupon the pins 11 slide down a ramp 110 to the entry 111 of the transfer conveyor 7. The entry 111 includes an inside guide bar 113 with a curved opening section 114. A rear guide bar 116 includes a catch portion 117 angled outwardly as shown in FIG. 23 to receive and turn the pin 11 as it slides from the ramp 110. A relatively narrow belt conveyor 119 travels between the front and rear guide bars 113 and 116 and terminates at an outlet end 120. The belt drive motor 122 is positioned at the outlet end 120. The transfer conveyor 7 is supported by a pivot 124 at its entry end 111 and slides on an elongate slide bar 125 at its outlet end 120. Support framework extends between the outlet end 120 and the underlying slide bar 125. Referring to FIG. 1, means for rotating the transfer conveyor 7 in an arcuate path is disclosed. In the illustrated example, an electric motor 128 is mounted below the transfer conveyor 7, an eccentric mechanism 129 extends between the motor 128 and the bottom of the transfer conveyor 7 and causes the transfer conveyor 7 to swing from side to side as called for by the controller.

At the outlet end 120 of the transfer conveyor 7, the pins 11 are transferred to the pin setting mechanism 9. The pin setting mechanism 9, FIG. 1, is a multi-layered structure and generally consists of an upper reel 131 and a lower setting plate 133 which moves up and down, both as indicated by the arrows in FIG. 1. A lowermost gripper plate 134 is attached to the setting plate 133 and moves upwardly and downwardly therewith and also relative to the setting plate 133. The upper reel 131 and the setting plate 133 include a plurality of pin receptacles 135 of which FIGS. 22–30 illustrate. Each receptacle 135 receives a pin from its top, grips same and releases it downwardly through its bottom as will be further described. Referring back to FIG. 22 which shows the upper reel 131 which receives its pins from the transfer conveyor 7. The upper reel 131 generally consists of a circular plate 137. The plate 137 is supported about its perimeter by a framework 138 with support rollers (not shown) extending between the bottom and outer edge of the circular plate 137 and the framework 138. The reel 131 is caused to rotate by a motor 140 which drives a friction wheel 141. The motor 140 and friction wheel 141 cause the upper reel 131 to rotate in one direction, such as a clockwise direction when viewed in plan view, FIG. 22. The upper reel 131 further includes series of timing slots 143. In the illustrated example, there are three series of timing slots 143. The slots 143 are of different widths and are open through the circulate plate 137 to enable a photo cell to derive a code from the size of the slot 143 which indicates the position of the upper reel 131. The upper reel 131 includes an array of holes 145 through the circular plate 137. As shown in FIG. 22, the holes 145 are arranged in a triangular and familiar ten pin bowling pattern. Also shown in FIG. 22, are attachment holes 146 adjacent each of the pin holes 145 to enable connection of the pin receptacle 135 over the hole 145.

Figure 26:
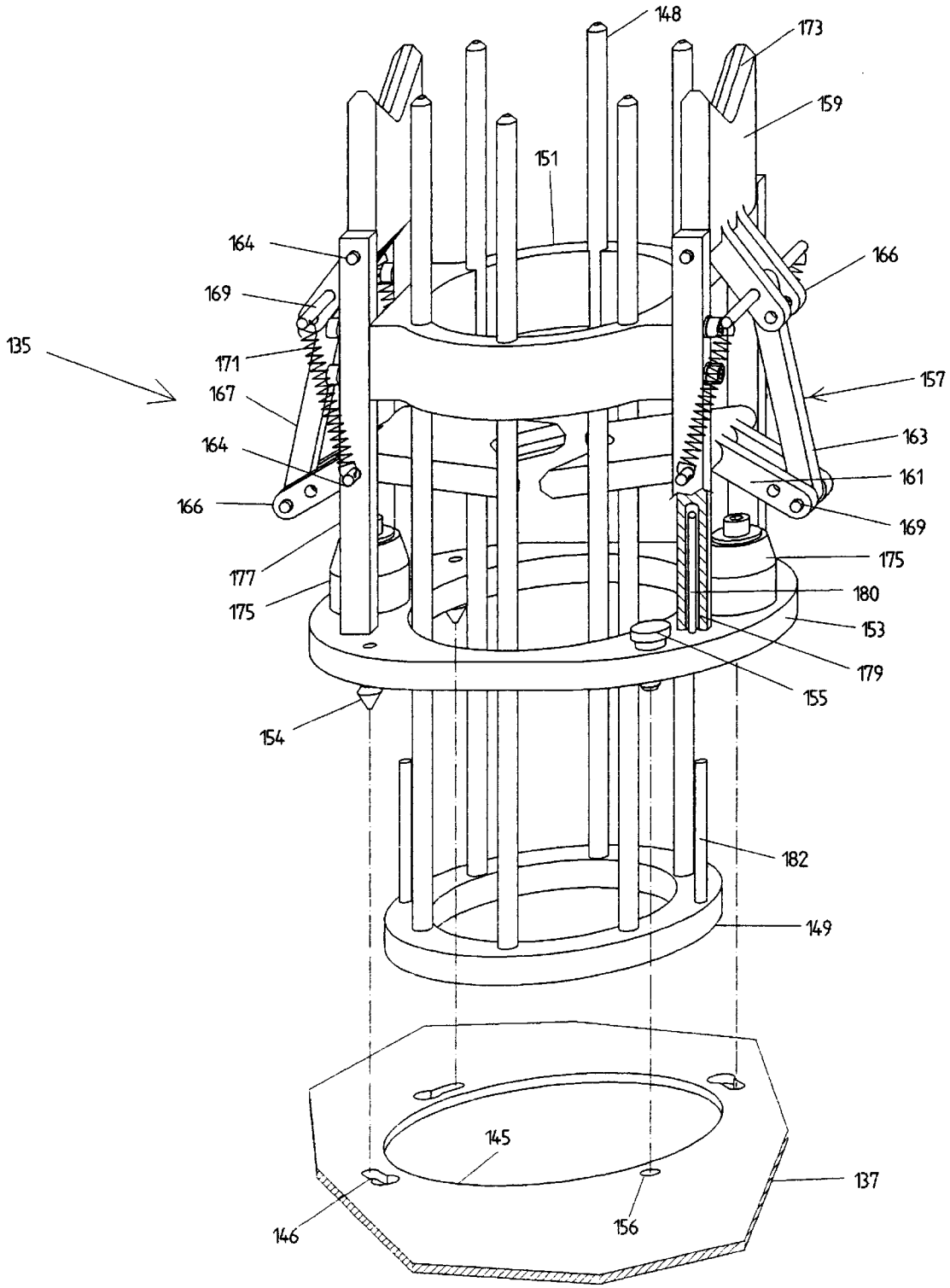
FIG. 26 is a longitudinal sectional view of the pin holding device showing it holding a pin in a second position.

Turning to FIG. 26, each pin receptacle 135 generally consists of a plurality of vertically arrayed rods 148, such as six in number which are maintained in relation to each other by a lower ring 149 and an upper ring 151 located slightly downwardly from the top margins of the rods 148, creating a tubular or cylindrical structure. The upper and lower rings 151 and 149 are in fixed position relative to the rods 148. An intermediate attachment ring 153 is positioned between the lower and upper rings 149 and 151 and includes stud pins 154 for attachment into the attachment holes 146 of the plate 137. A fixing pin 155 extends into a similar attachment hole 156 located there below. A catch arm mechanism 157 is positioned upwardly of the intermediate attachment ring 153 and extends about the upper ring 151. In the illustrated example, the catch arm mechanism 157 includes an upper catch arm 159 and a lower trip arm 161, which are swingably mounted respectively by pivot pins 64 at respective outer ends 164 and 165. Dog legs 166 extend angularly outwardly from the pivot pins 164. Connecting rods 167 extend between the upper and lower dog legs 166 and are connected by pivot pins 169, as shown in FIG. 26. As will be seen in the drawings some of the pivot pins 169 are elongate so as to permit connection of a biasing means, such as a coil spring 171 which extends between the pivot pin 169 and an extension of the pivot pin 164. The tension of the coil spring 171 draws the upper catch arm to a normally straight up or open position and the lower trip arm 161 to a normally extended or substantially perpendicular position, FIG. 26. Each of the upper catch arms 159 and lower trip arms 161 have V-shaped ends 173 with chamfered edges for smooth transition. Situated immediately below each of the catch arm mechanism 157, which are preferably diametrically opposed about the pin receptacle 135, are stops 175. The stops 175 are preferably elastomeric coated so as to absorb any shocks there against.

The intermediate attachment ring 153 is slidable upward and downwardly on the pin receptacle 135. A vertical support bar 177 is affixed to the upper ring 151 and has attached thereto the pivot pins 164 and 169 for carrying the catch arm mechanism 157. However, the pin receptacle 135 with the upper and lower rings 149 and 151 can move vertically with respect to the intermediate attachment ring 153. The vertical support bar 177 is not connected at its lower end to the intermediate attachment ring 153 but has an internal guide bore 179 into which is received a guide pin 180 extending upwardly from the intermediate attachment ring 153. The guide pin 180 slides within the guide bore 179 of the vertical support rod 177 to maintain vertical alignment between the two. The intermediate attachment ring 153 is limited in its downward movement toward the lower ring 149 by stop rods 182.

Figure 25:
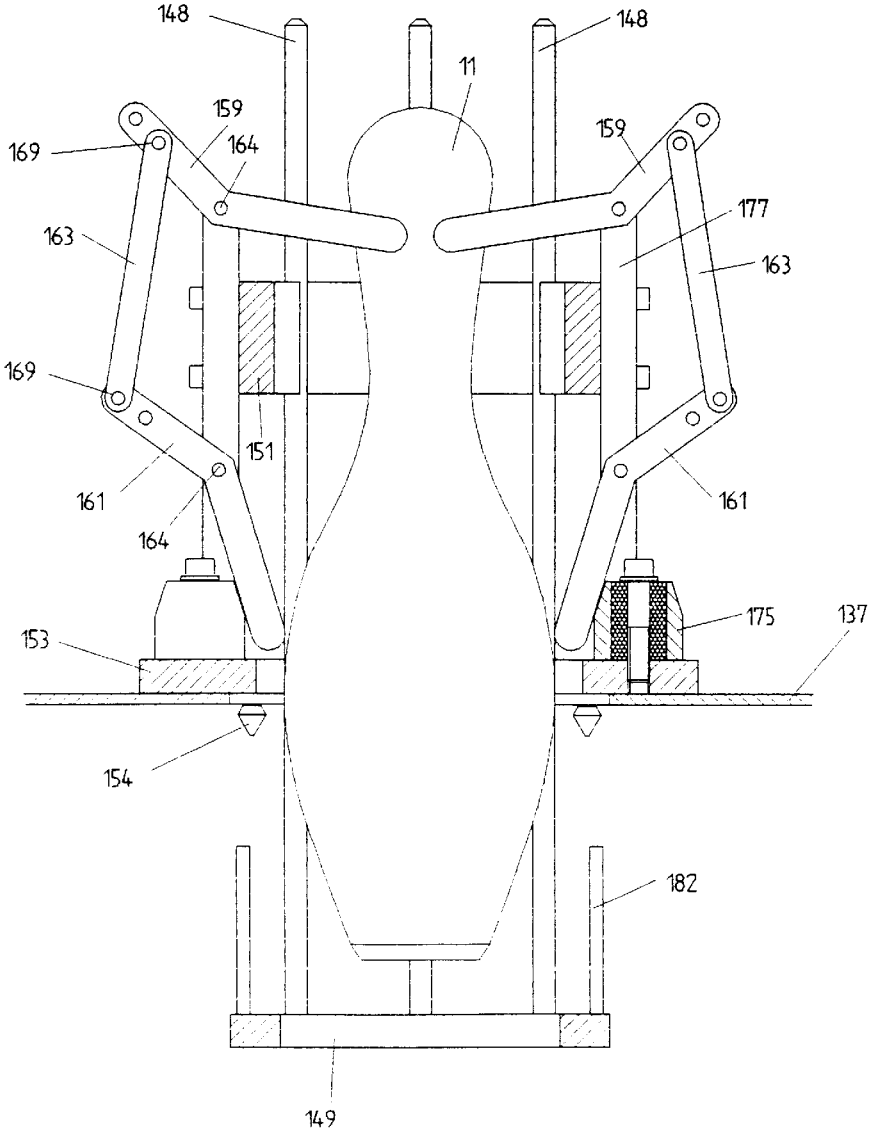
FIG. 25 is a longitudinal sectional view of the pin holding apparatus showing the device holding a pin in a first position.
Figure 27:
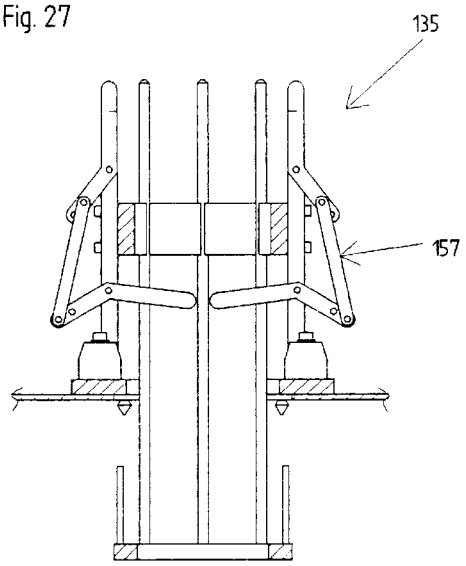
FIG. 27 is a longitudinal sectional view of the pin holding device showing it holding the pin in the first operational position.
Figure 29:
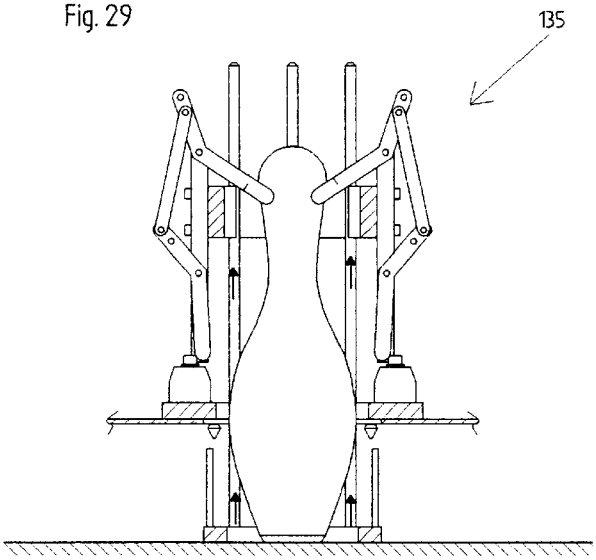
FIG. 29 is a longitudinal sectional view showing a pair of pin holders in stacked relationship and showing a pin transferred from the upper pin holding device to a lower holding device.
Figure 28:
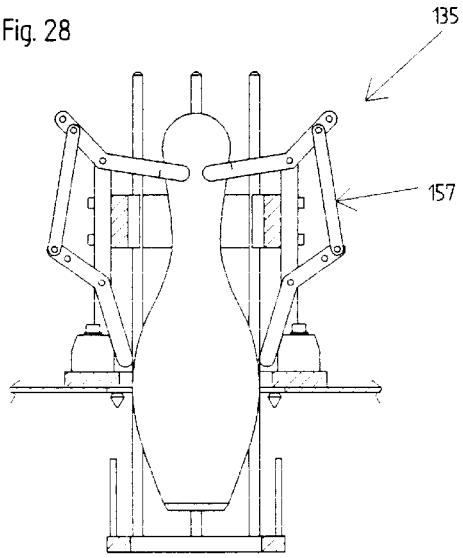
FIG. 28 is a longitudinal sectional view showing a pair of pin holders in stacked relationship and showing a pin in the upper pin holding device.
Figure 30:
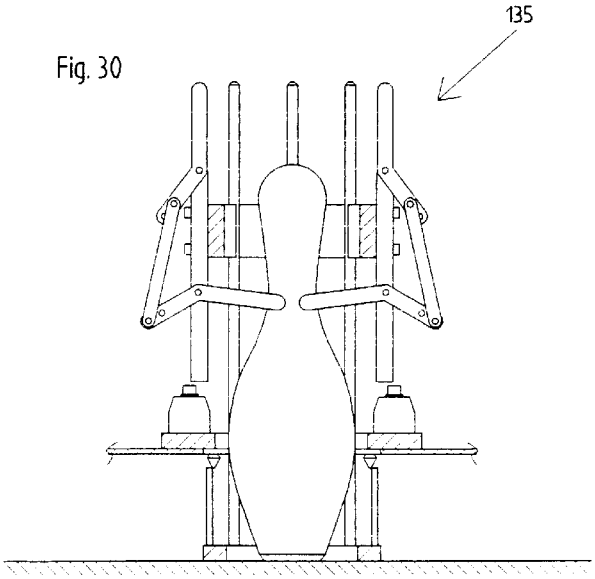
FIG. 30 is a perspective view of the pin holding device.

In operation, FIG. 25, a pin 11 is distributed via the transfer conveyor 7 into a selected pin receptacle 135 corresponding to one of the array of bores 145 as shown in FIG. 22. The pin 11 enters foot first and falls into the open top of the pin receptacle 135. As the pin falls, the base of the pin contacts and pushes downwardly on the lower trip arm 161, causing the arm 161 to swing downwardly, overcoming the initial resistance of the spring 171 and causing the toggle connecting rods 167 to cause the upper catch arm 159 to spring and rotate downwardly, catching the neck of the pin 11 as it falls. The force of the arrestment of the bowling pin 11 is absorbed in large extent by the elastomeric coated stops 175, as the lower trip arms 161 swing against the stops 175. Consequently, the bowling pins 11, as delivered by the transfer conveyor 7, are retained and maintained in a ready position in the reel 131 and in the proper array or pattern for use. FIGS. 27 and 28 show a sequence of operation in which a bowling pin 11 is dropped into an unoccupied or open pin receptacle 135, is caught by the lower trip arms 161 and maintained in position by the upper catch arms 159, FIG. 28. Each pin receptacle 135, whether mounted in the upper reel 131 or on the setting plate 133, includes both a catch and a release mechanism. The pin receptacles 135 release the pins by slight upward movement of the lower ring 149 coming into contact with an underlying object. Thereupon, the upper and lower rings 151 and 159 and the rods 148 which form the tubular receptacle move upwardly in relation to the intermediate attachment ring 153. As the lower ring 149 pushes upwardly with respect to the intermediate attachment ring 153, the lower trip arms 161 disengage from the sides of the stops 175, the V-shaped ends 173 of the upper catch arms 159 are rotated downwardly, increasing the distance between them and allowing the bowling pin 11 to fall free. After the head of the bowling pin 11 has cleared the upper catch arms 159, the springs pull the catch arm mechanism 157 back to the ready position shown in FIG. 27. FIG. 29 indicates an intermediate position as would occur during the moment of releasing the pin, wherein the pin is moving downwardly. FIG. 30 indicates the position of the pin 11 and the relationship of the parts of the pin receptacle 135 after the pin 11 has been released but before the pin receptacle 135 has been raised clear of the pin 11.

Figure 31:
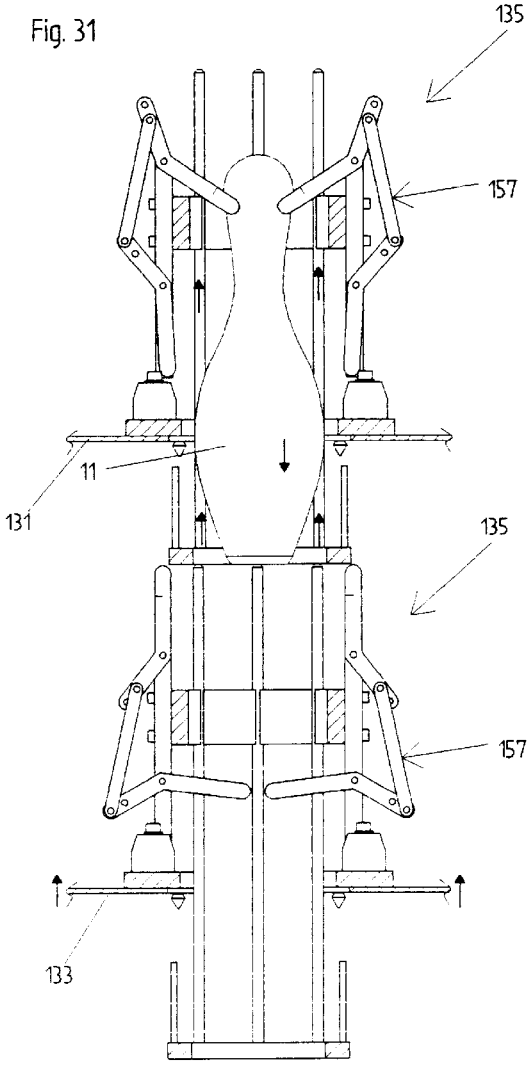
FIG. 31 is a fragmentary plan view showing a plurality of pin positioning arms.
Figure 32:
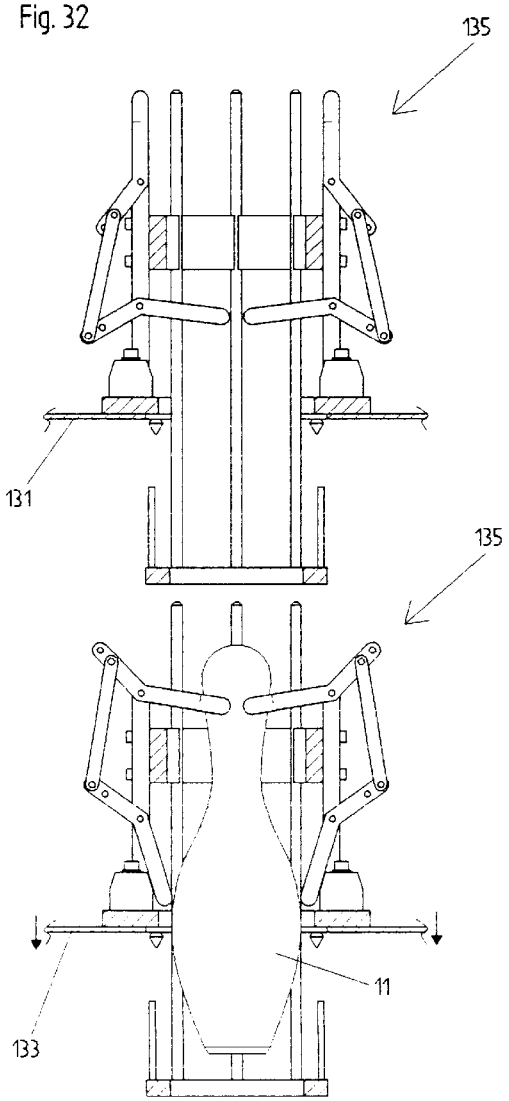
FIG. 32 is a fragmentary, side elevational view of the pin positioning arm.
Figure 33:
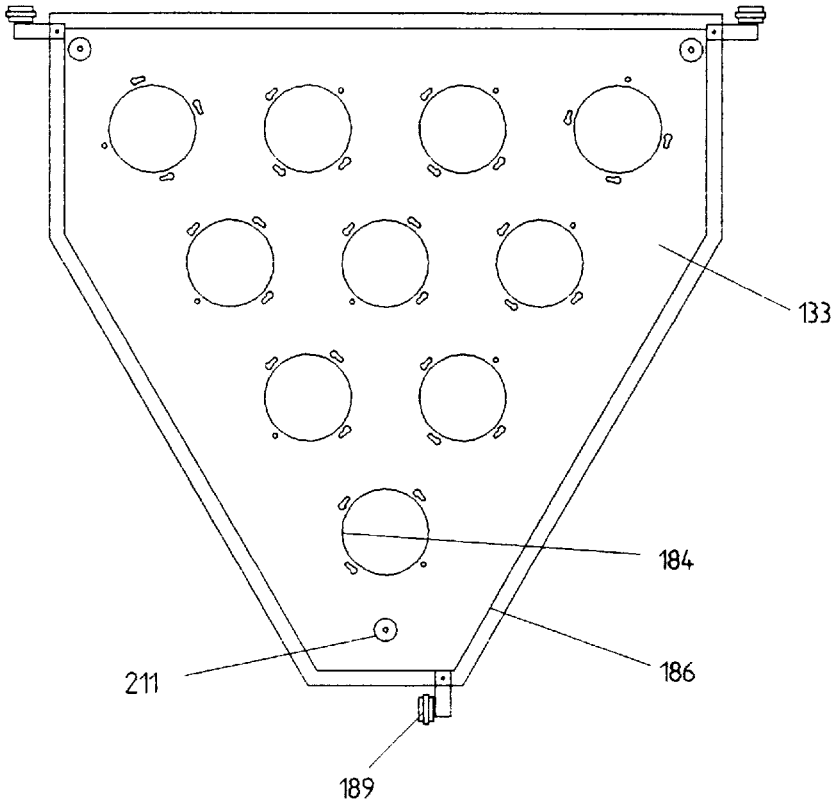
FIG. 33 is an enlarged plan view of the pin positioning arms.
Figure 34:
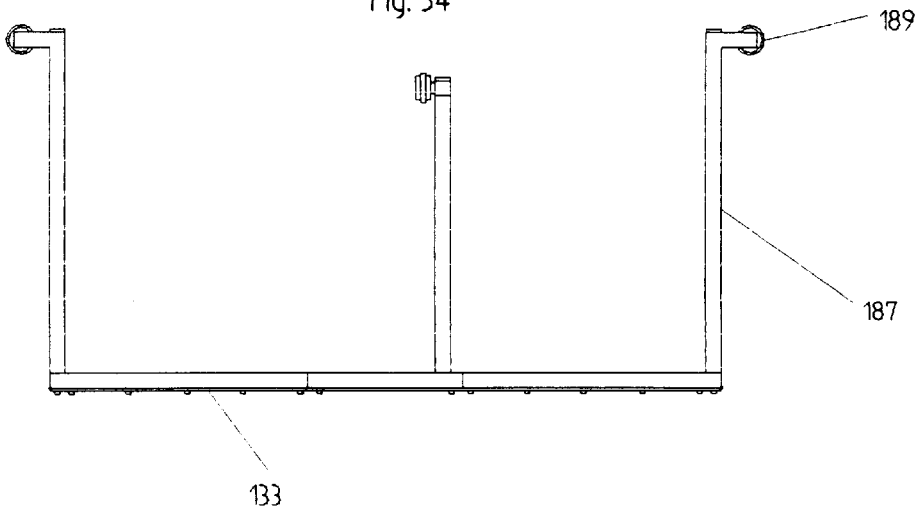
FIG. 34 is an enlarged fragmentary view showing details of construction of the pin holding arm arrangement.

The setting plate 133 is positioned under the upper reel 131 and is generally in the same configuration. FIG. 33 is a plan view of the setting plate 133, which is situated under and in alignment with the upper reel 131. The setting plate 133 likewise includes an array of bores 184. The array of bores 184 is the same as the array of bores 145. The setting plate 133 may be of substantially any outer configuration but as shown here, is generally of a triangular configuration to match the triangular array of the bores 184. The setting plate 133 is bounded by a perimeter frame 186 and includes a plurality of vertical stanchions 187 extending upwardly from the perimeter frame 186. FIG. 34 illustrates the perimeter frame 186 and the stanchions 187. The stanchions 187 terminate in rollers 189 which ride in the supporting framework 4 and the pin setting mechanism 9. The rollers 189 ride against the side of the pin setting mechanism framework so that the setting plate 133 moves up and down in relation to the revolving upper reel 181. A motor 191 drives a cable winch 192, FIG. 22, to pull upon a cable 194 run about pulleys (not shown). A shaft 196 extends from the cable winch 192 to provide equal rotation of the pulleys. The setting plate 133 also includes a plurality of pin receptacles 135, one for each hole. These pin receptacles are identical to the pin receptacles mounted in the upper reel 131. The machine controller guides the proper vertical orientation of the upper reel 131 and the setting plate 133 so that the pin receptacles 135 of each are in vertical alignment. FIGS. 31 and 32 are sequential views showing that a pin receptacle 135 mounted in the upper reel 131 is positioned in vertical alignment with a pin receptacle 135 mounted in the setting plate 133. In the sequence of operation shown in FIG. 31, the setting plate 133 has been moved upwardly in relation to the stationary upper reel 131. The pin receptacle 135 of the setting plate 133 has contacted and is in the process of releasing the pin 11 from the upper pin receptacle 135. After being released, the pin will fall downwardly into the lower pin receptacle to trip the lower trip arms 161 and be caught and held by the upper catch arms 159 of the catch arm mechanism 157. FIG. 32 shows the upper pin receptacle 135 empty and the lower pin receptacle 135 retaining the pin 11 with the setting plate 133 again moved downwardly and out of contact with the pin receptacle 135 of the upper reel 131. The setting plate 133 may continue downwardly so that the bottom of the pin receptacle 135 contacts the surface of the bowling alley where the pins are to be set and deposits the pin at that location. Accordingly, the upper reel 135 only revolves and is maintained in elevation. The setting plate 133 moves up and down to first take the pins in the pin receptacles 135 carried by the setting plate and then deposit those pins on the surface of the alley 14.

In bowling games, the pins are not all removed after a roll of the bowling ball and some are left standing. In the typical game, after a roll of the ball, the standing pins are lifted and the alley swept clear. To that end, the present invention uses a sweeper bar 199 which extends across the face of the alley. The sweeper bar 199 is driven by a chain 202 which is trained about pulleys 204 and driven by a motor 205 connecting like pulleys through a common shaft 206. The sweeper bar 199 also provides a gate function in that the sweeper bar is a relatively solid, planar structure which may both sweep the alley of upset pins 11 but also, upon return to the forward position, FIG. 1, protect the resetting machinery against throws from bowling balls while the machinery is in its setting operations.

The gripper plate 134 automatically comes down every time the setting plate 133 comes down. To this effect, the gripper plate 134, FIG. 34, is a generally triangular shape to match the shape of the setting plate 133 and is bounded by a framework 208. Stanchions 209 extend upwardly from corners of the gripper plate 134 and terminate in heads 211 that are mounted in the setting plate 133 so that the gripper plate 134 is suspended below the setting plate 133.

Figure 37:
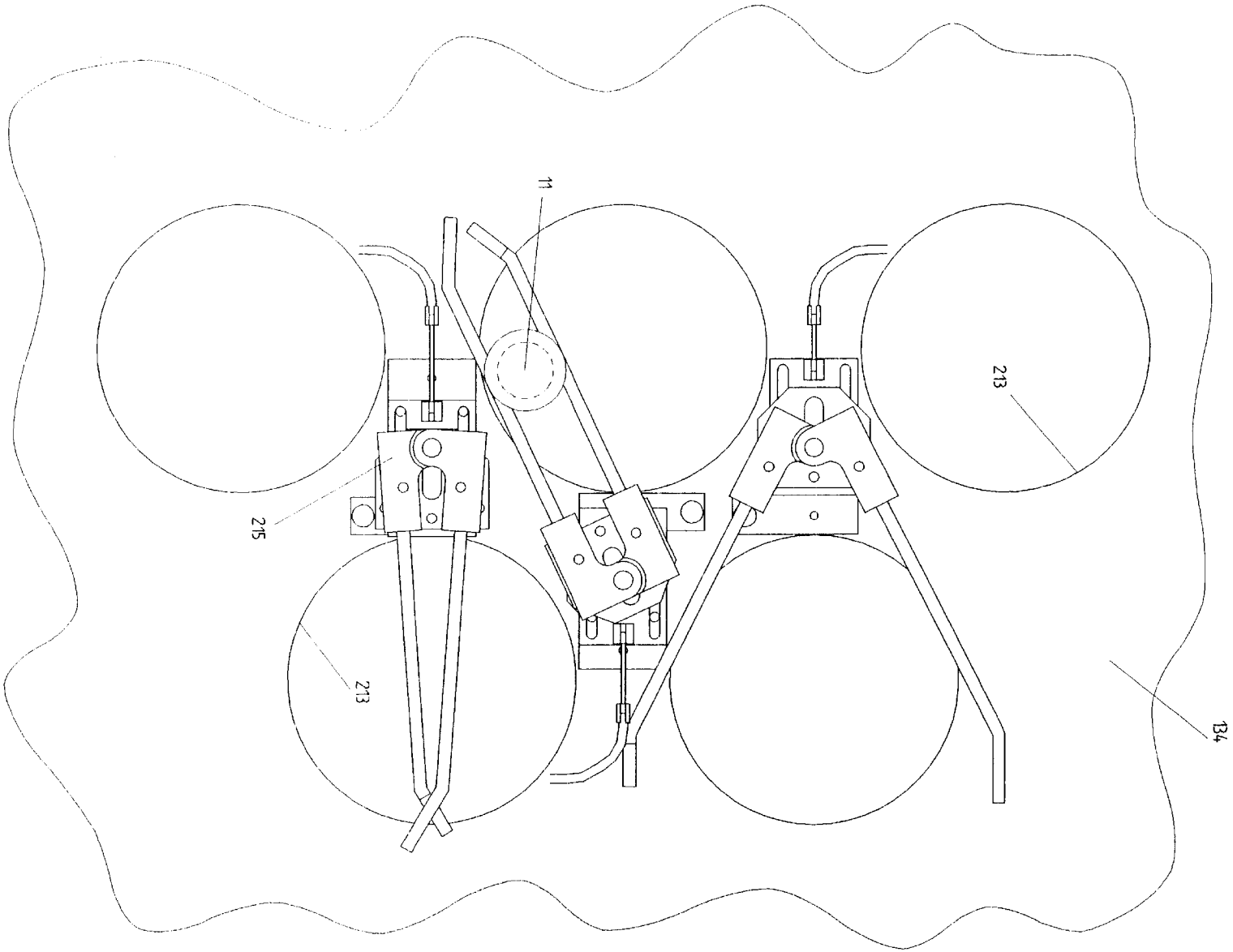
FIG. 37 is an enlarged fragmentary view showing details of construction of the pin holding arm arrangement.
Figure 38:
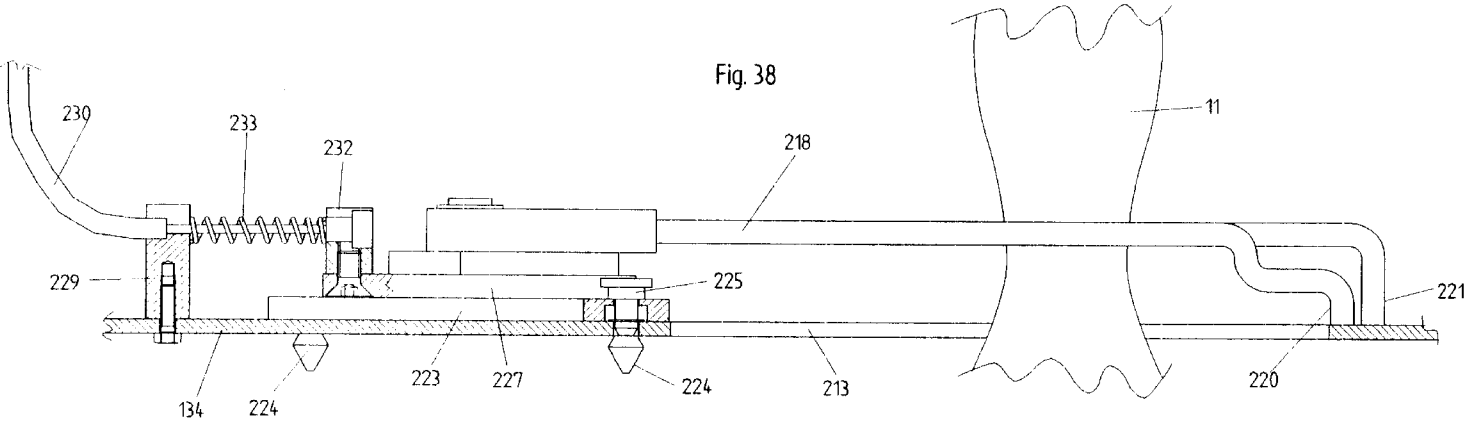
FIG. 38 is a perspective view of the pin holding arm arrangement and showing same in the first operational position.
Figure 39:
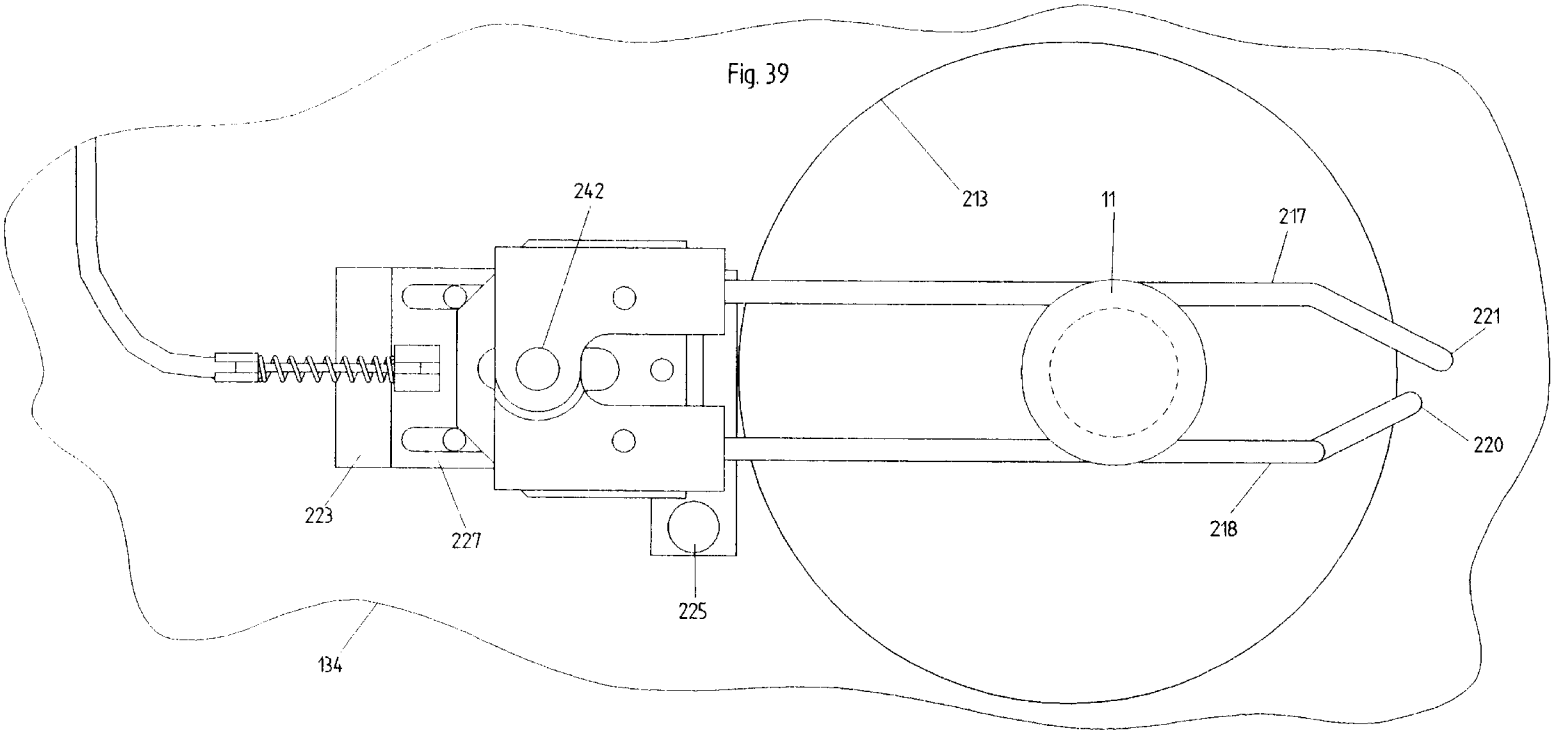
FIG. 39 is a perspective view of the pin holding arm arrangement and showing same in a second operational position.
Figure 40:
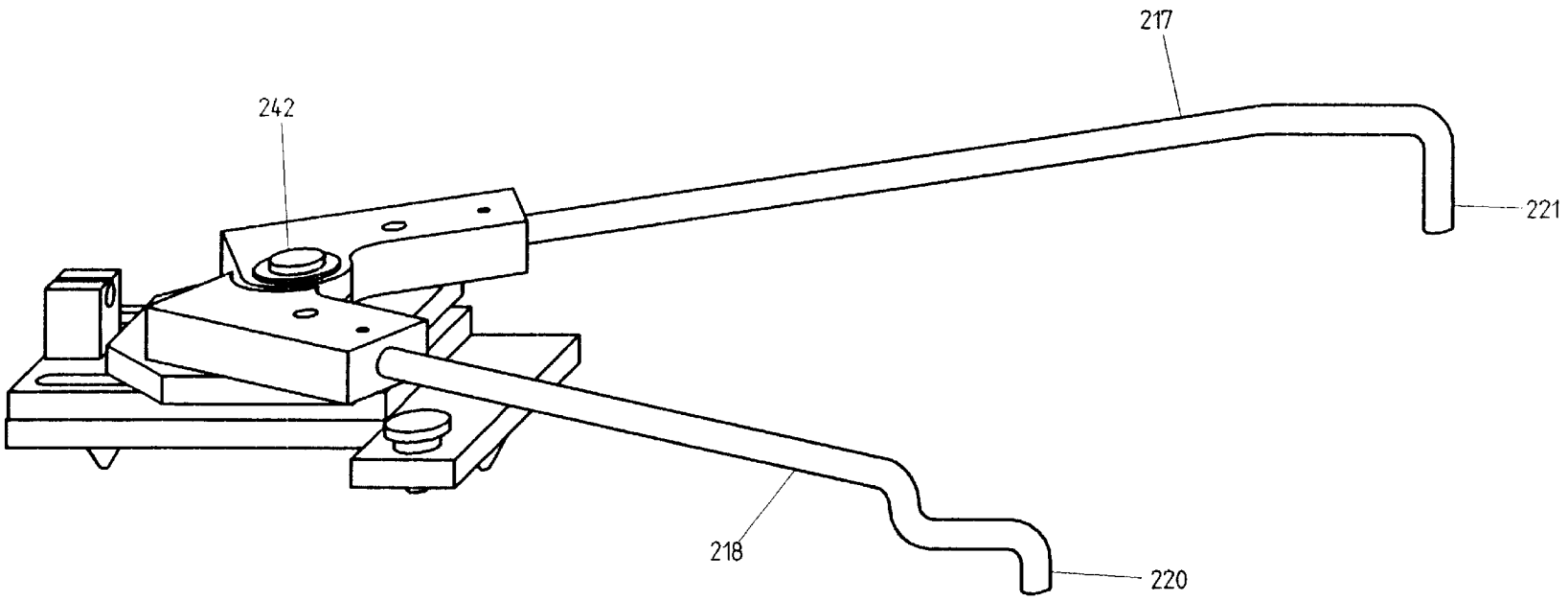
FIG. 40 is a fragmentary, side elevational view of a cable pull arrangement for actuating the grippers.
Figure 41:
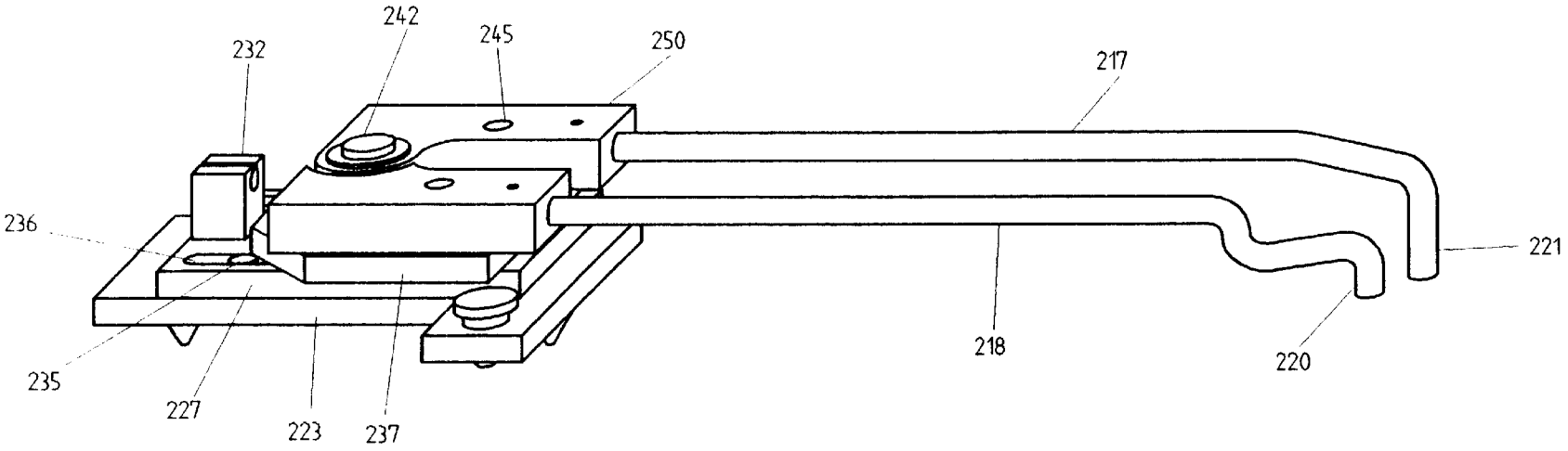
FIG. 41 is a fragmentary, plan view showing a cable pull arrangement for controlling the grippers.
Figure 42:
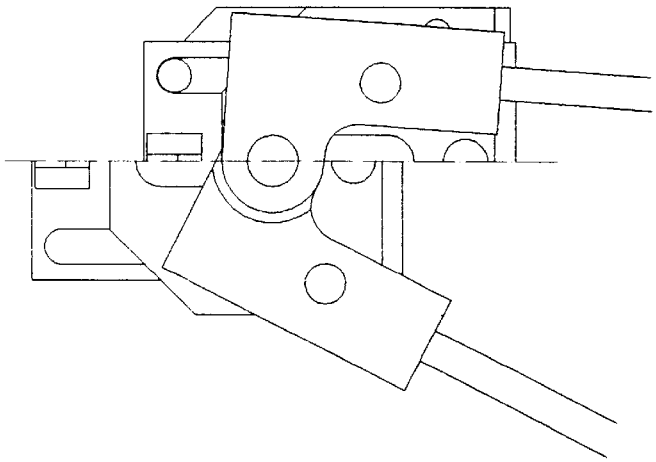
FIG. 42 is a fragmentary, plan view showing the gripper cable push pull device.
Figure 43:
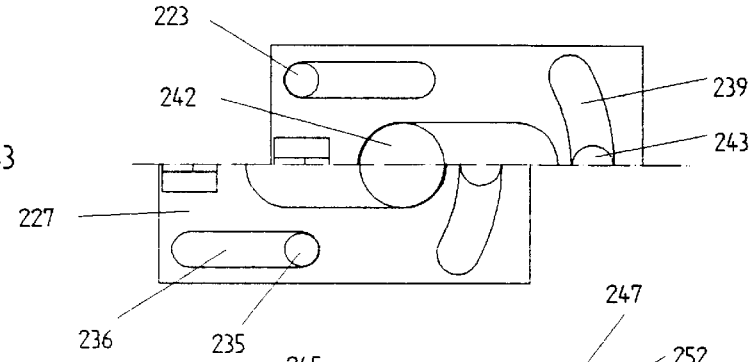
FIG. 43 is a fragmentary, plan view of the gripper cable push pull device.
Figure 44:
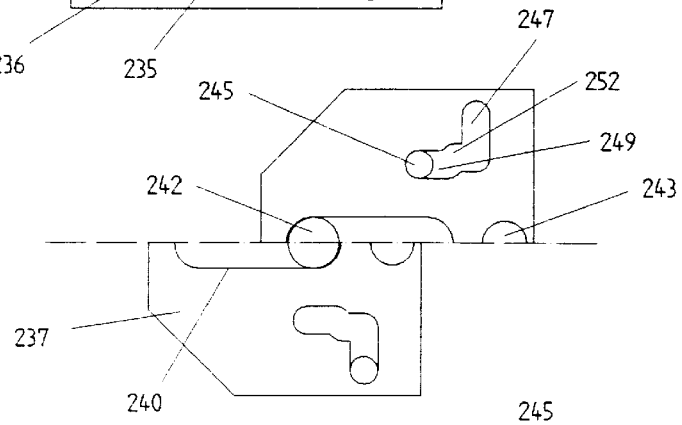
FIG. 44 is a fragmentary, plan view of a portion of the gripper cable push pull device.
Figure 45:
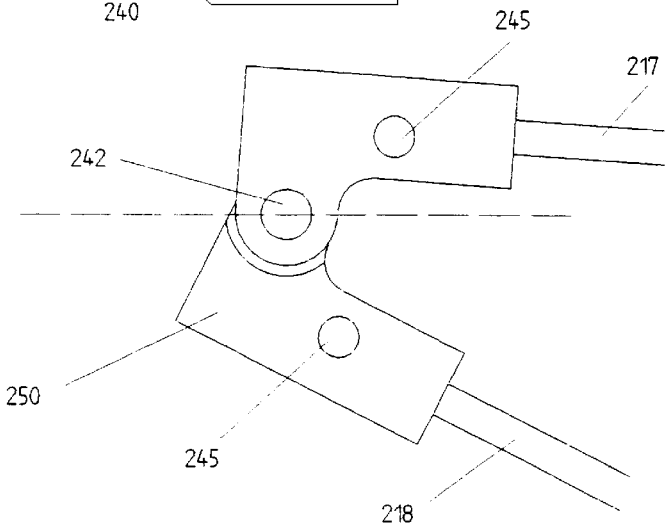
FIG. 45 is a fragmentary, plan view of a portion of the gripper arms mounting mechanism.
Figure 46:
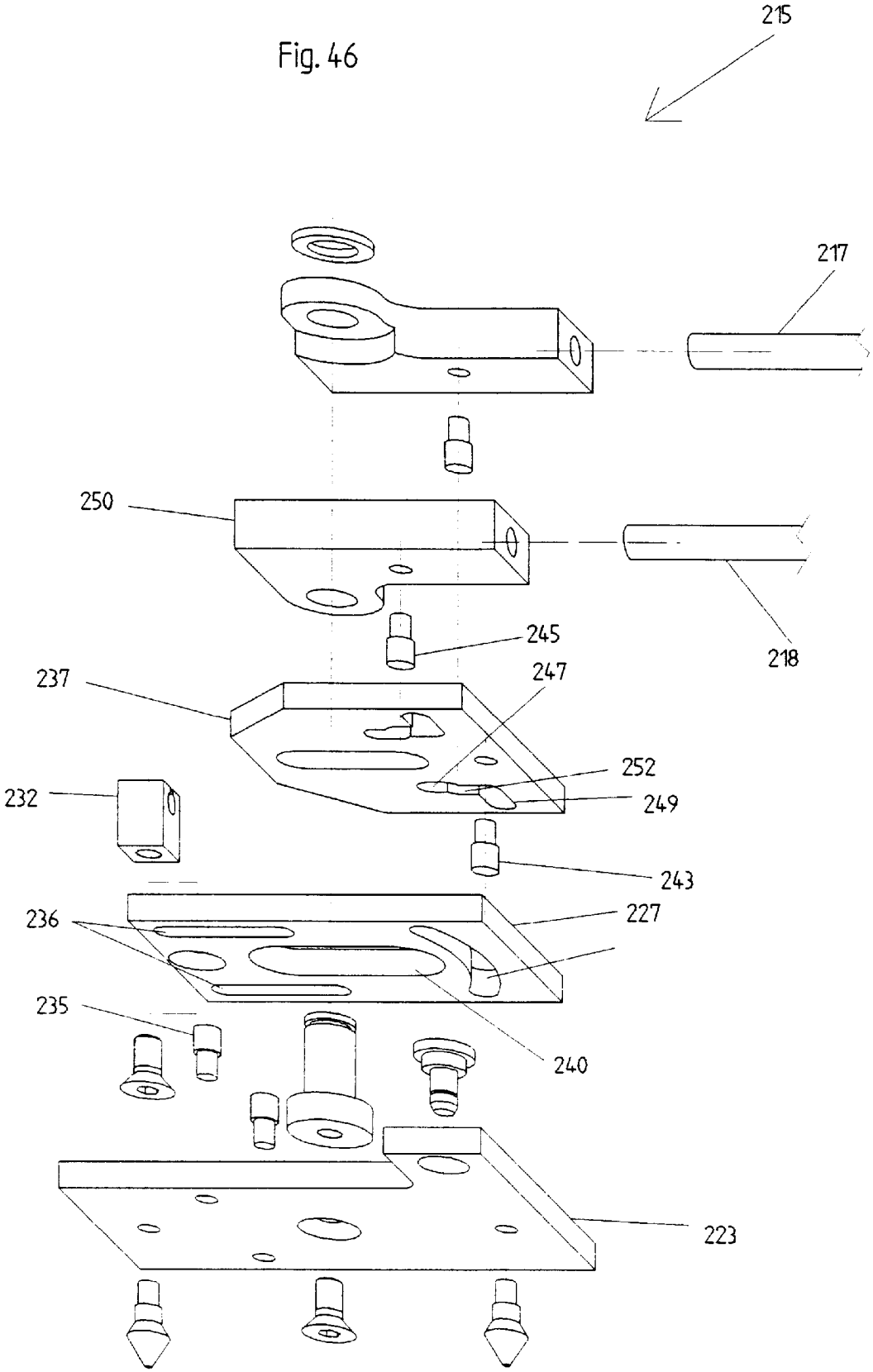
FIG. 46 is a perspective, disassembled view of the gripper arms mounting mechanism.

The gripper plate 134 has a like number of holes 213 as the setting plate 134 and the upper reel 131. Adjacent each of the holes 213 is a gripper mechanism 215 used for centering and then lifting each pin remaining standing after a throw of a ball on the alley. An enlarged view of the gripper mechanism 215 is shown in connection with FIG. 37 wherein is disclosed a lifting mechanism which retrieves the pin 11 from the position left standing on the alley 14. The gripper mechanism 215 is self-centering so that while the mechanism centers, the pin 11 does not and is lifted and set down in the same position from which it was found. Each gripper mechanism 215 includes, referring to FIGS. 38–45, a pair of gripper arms 217 and 218 each of which are differently shaped than the other. The arms 217 and 218 have downturned staggered tips 220 and 221 which extend sufficiently far over the hole 213 to ride on the opposite side of the hole for support. The gripper mechanism 215 includes a base plate 223 secured to the gripper plate 134 by studs 224 and a latch 225. Atop the base plate 223 is a first slide plate 227. A cable attachment 229 is mounted adjacent the base plate 223 and attaches a pincher cable 230 thereto. The cable 230 extends from the cable attachment 229 to a cable block 232 with a spring 233 therebetween to push the cable block 232 to an outward position. The cable block 232 is attached to the slide plate 227. The slide plate 227 only slides forwardly and rearwardly of the base plate 223 by means of fasteners or studs 235 mounted in channels 236. A swing plate 237 is mounted atop the slide plate 227. The slide plate 227 includes at its arm end an arcuate slot 239 (see FIG. 43) and a center slot 240. Accordingly, the slide plate 227 moves longitudinally atop the base plate 223. The swing plate 237 is connected to the base plate via the slide plate 227. A center pin 242 extends downwardly through the center slot 240 and into the base plate 223. A center pin 243 extends downwardly from the swing plate 237 and into the arcuate slot 239 of the slide plate 227 and permits turning of the swing plate 237 on the slide plate 227 within the arc defined by the arcuate slot 239. The swing plate 237 drives movement of the arms 217 and 218. The arms include pincher arm bases 250. The pincher arm basis 250 are mirror image and interconnected by the center pin 242. Drive pins 245 extend downwardly from intermediate portions of the pincher arm bases and extend into generally L-shaped slots 246 in the swing plate 237. As shown in FIG. 44, the L-shaped slots 246 are substantially mirror image of each other and include a transverse section 247 which causes the pincher arms 217 and 218 to swing toward and away from each other. The transverse sections 247 curve into a lateral section 247 via a transitional curve portion 252. In operation, the gripper mechanism 215, as shown on the disassembled view of FIG. 46, in review, the slide plate 227 is urged fore and aft by the cable fore and aft movement of the slide plate is caused through the cable. The slide plate moves longitudinally upon the base plate. As the slide plate moves fore and aft, it carries with it the swing plate 237 via a pin 245 received in the arcuate slot 239. The swing plate 237 carries with it the arm bases 250 via the pins 245 which extend from the L-shaped slots 246. The arms open and close via the pin 243 being forwardly relative to the swing plate 237 so that the pin 245 is received within the transverse section 247 of the L-shaped slots 246. When the cable is pulled or returned by the cable spring 233, the slide plate 227 is moved aft relative to the base plate 223 and carries with it the swing plate 237, moving the pins 245 aft within the L-shaped slots 246 to the lateral section 249. The receipt of the pins 245 within the lateral sections 247 locks the arms together about any bowling pin 11 that is received therebetween.

The arms 217 and 218 may be open or closed and are free to rotate together via the pin 243 traveling from one end to the other within the arcuate slot 239. In this manner, the arms 217 and 218 become self-centering with respect to the base plate 223 so as to engage about a bowling pin 11 which is left standing off center of the proper alley position. This arrangement permits the gripper mechanism 215 to engage and pick up a bowling pin 11 which is left standing in any area covered by the hole 213, FIG. 39. If the pin 11 is centered within the hole, it will not be necessary for the gripper mechanism 215 to self-center. If the bowling pin 11 is left standing off-center relative to the hole 213, self-centering by the gripper mechanism 215 is necessary, operationally, one of the arms 217 or 218 will first touch the appropriate side of the bowling pin 11 and stop, permitting the other arm to continue to swing and engage the bowling pin from the opposite side of the neck. At the point where swinging travel of one of the arms 217 or 218 ceases because of hitting an obstruction, such as the bowling pin 11, the swing plate starts its rotation relative to the slide plate because of the pin 243 was received within the arcuate slot 239. After both arms 217 and 218 engage the bowling pin, the slide plate 227 begins to move rearwardly to cause the pins 245 to lock into the transitional curve section 252 of the L-shaped slots 246. This occurs if the arms 217 and 218 are being held apart in a generally parallel relationship because they have trapped the neck of a bowling pin 11 therebetween. This forces the pins 245 into the transitional curve section 252 and does not permit the pins to travel rearwardly further and into the lateral section 249. If the arms 217 and 218 are allowed to come further together, that is if there is no pin 11 between the arms, then the pins 245 will travel rearwardly all the way into the lateral section 249. This distinction permits a further retraction of the cable relative to the gripper mechanism 215 and permits the cable 230 to signal to the controller that either a pin has been picked up or no pin has been picked up.

Figure 35:
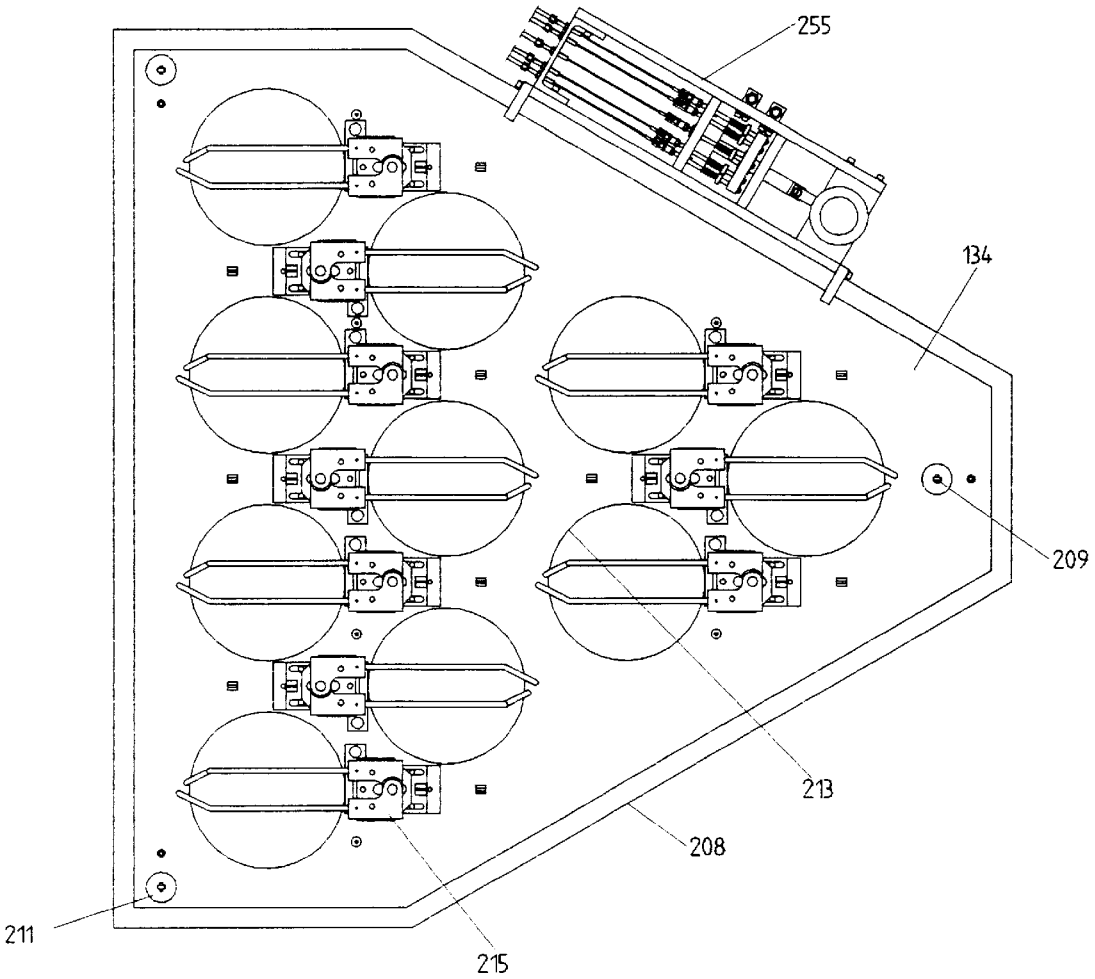
FIG. 35 is an enlarged fragmentary view showing details of construction of the pin holding arm arrangement.
Figure 36:
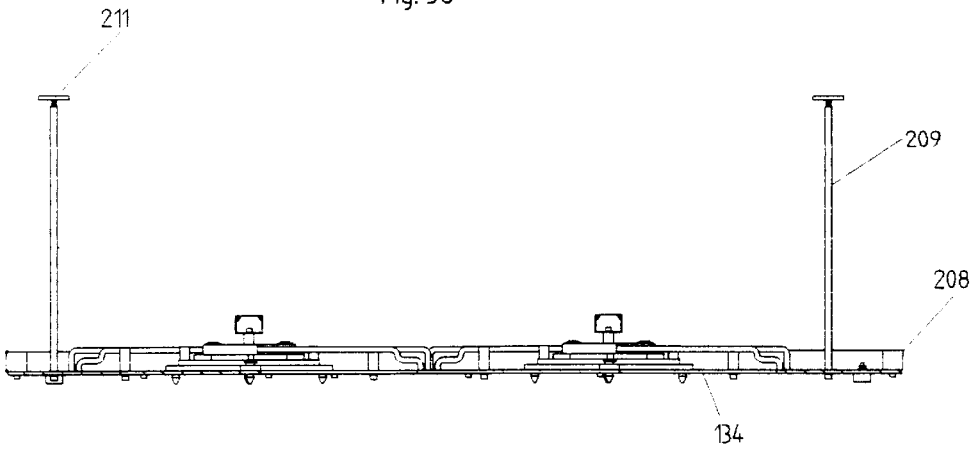
FIG. 36 is an enlarged fragmentary view showing details of construction of the pin holding arm arrangement.
Figure 47:
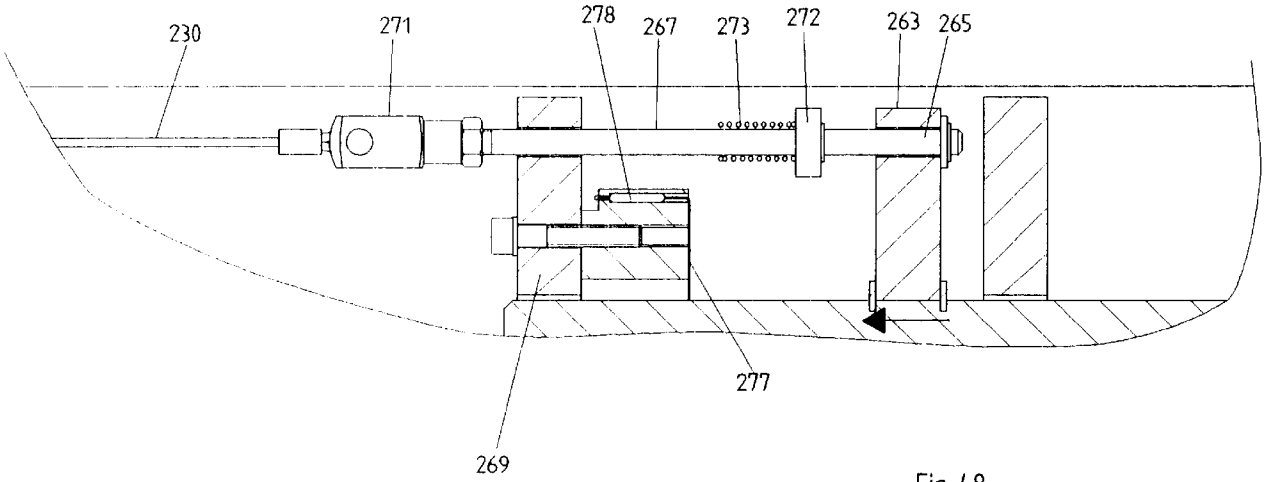
FIG. 47 is a fragmentary, side elevational view of an end of the gripper arms cable opposite from the gripper arms.
Figure 48:
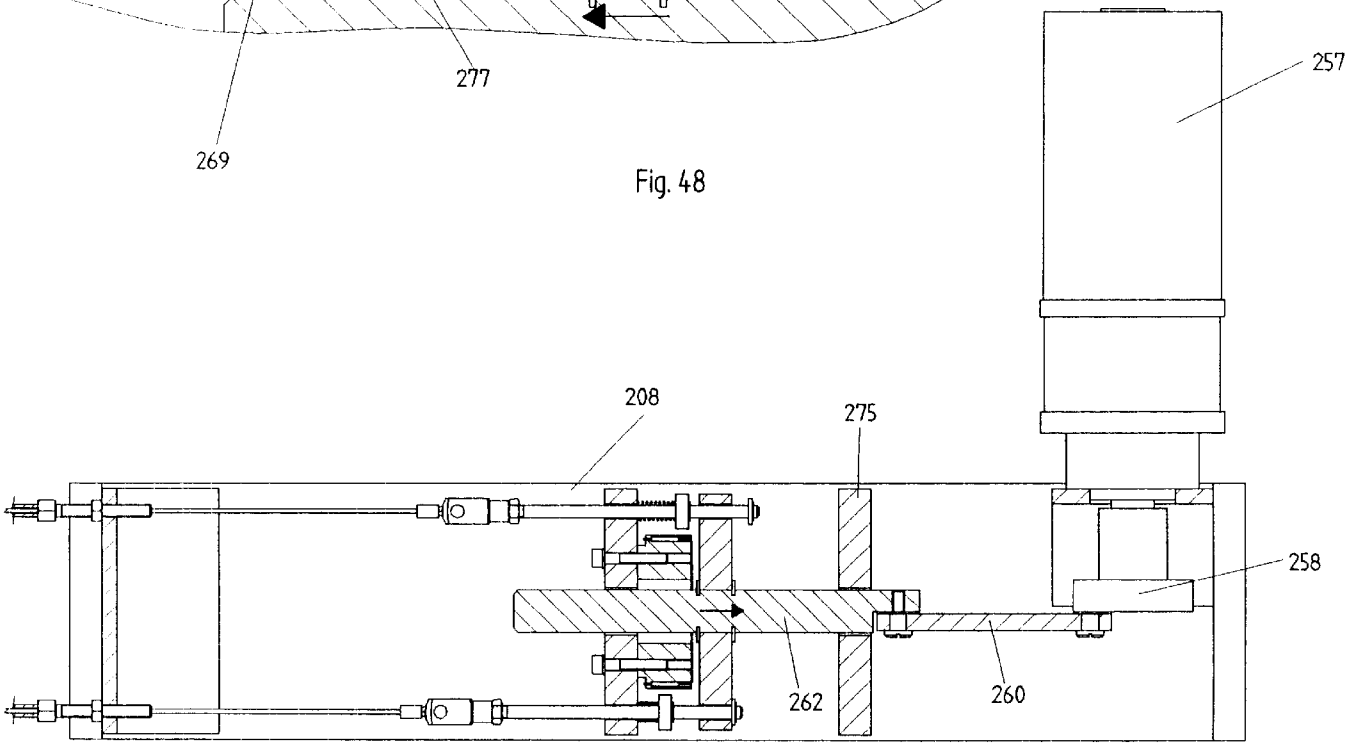
FIG. 48 is a fragmentary, plan view of a cable pull arrangement for the gripper arms.

A grip arm drive 255 is mounted to the side of the gripper plate 134, such as on the framework 208, FIG. 35. The cables 230 extend from the grip arm drive 255 to each of the gripper mechanisms 215. The grip arm device 255 is shown in more detail in FIGS. 47 and 48 wherein is disclosed a motor 257 which rotates an eccentric 258 to cause fore and aft movement of an arm 260. The arm 260 pulls upon a central shaft 262 about which is mounted a distribution plate 263 which travels with the fore and aft movement of the shaft 262. The cables 230 have cable ends 265 as secured to the distribution plate 263 so that as the distribution plate 263 moves, it pulls upon the cables 230. The cables 230 include an end rod 267 which travels through a fixed plate 269 which is in turn mounted to the support framework 208. The forward end of the end rod 267 includes a cable connector 271 and intermediate thereon a magnet 272 backed by a spring 273. As the fixed plates 269 and 275 guide the shaft 262 therethrough. A magnetic sensor mounting block 277 is fixed to the inside of the fixed plate 269 and carries magnetic sensors 278 which sense the position of the magnet 272 on the shaft 262 as it comes into engagement. Preferably, the magnetic sensor 278 is of the magnetic strip within a glass vial type and which is closed by the proximity of the magnet 272. The grip arm drive 255 through the sensors components 272, 277 and 278 senses the presence of a bowling pin 11 in one or more of the gripper mechanisms. If there is no pin in a particular gripper mechanism, the cable is pulled out further via the spring, causing the magnet 272 within the grip arm drive to extend adjacent to and complete the circuit at the magnetic sensor mounting block 277. If there is a pin in the gripper mechanism 215, the magnet 272 will not extend to the magnetic sensor mounting block 277 thereby not sending a signal.

Figure 49:
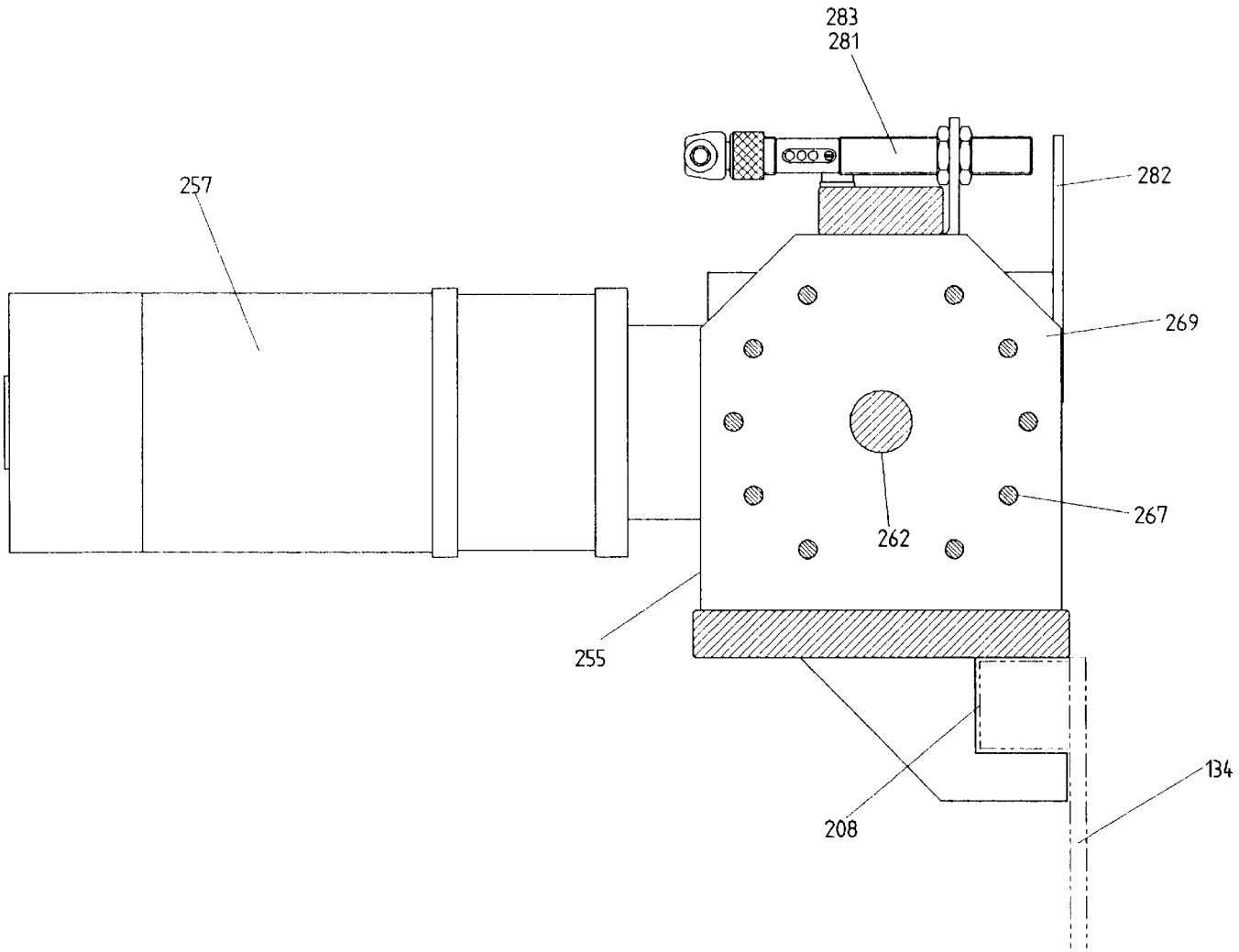
FIG. 49 is a fragmentary, end elevational view of the cable pull arrangement shown in FIG. 48
Figure 50:
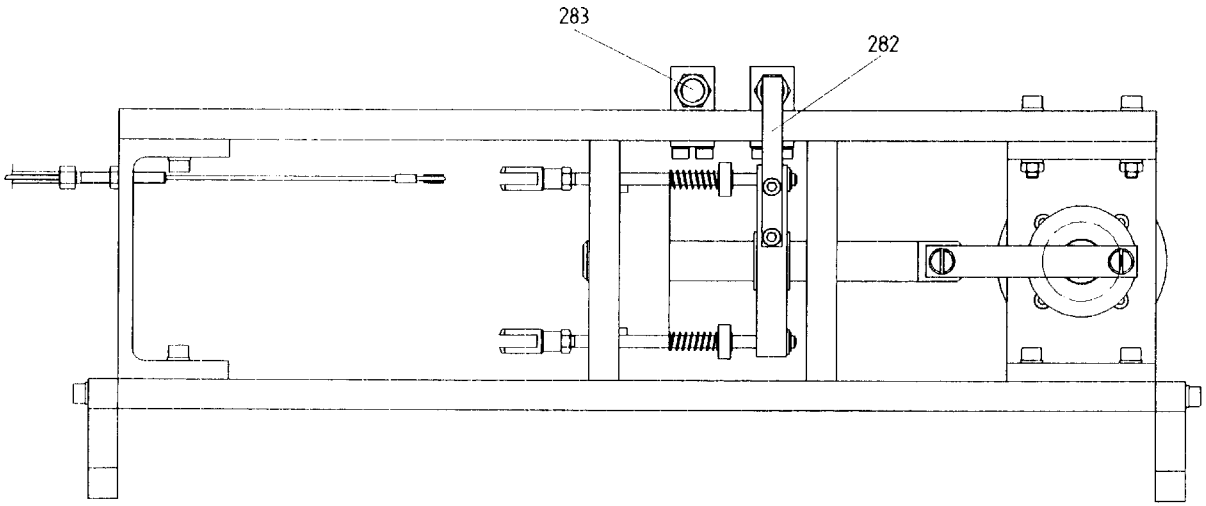
FIG. 50 is a fragmentary, plan view of the cable pull arrangement and showing the cable pulled inwardly.
Figure 51:
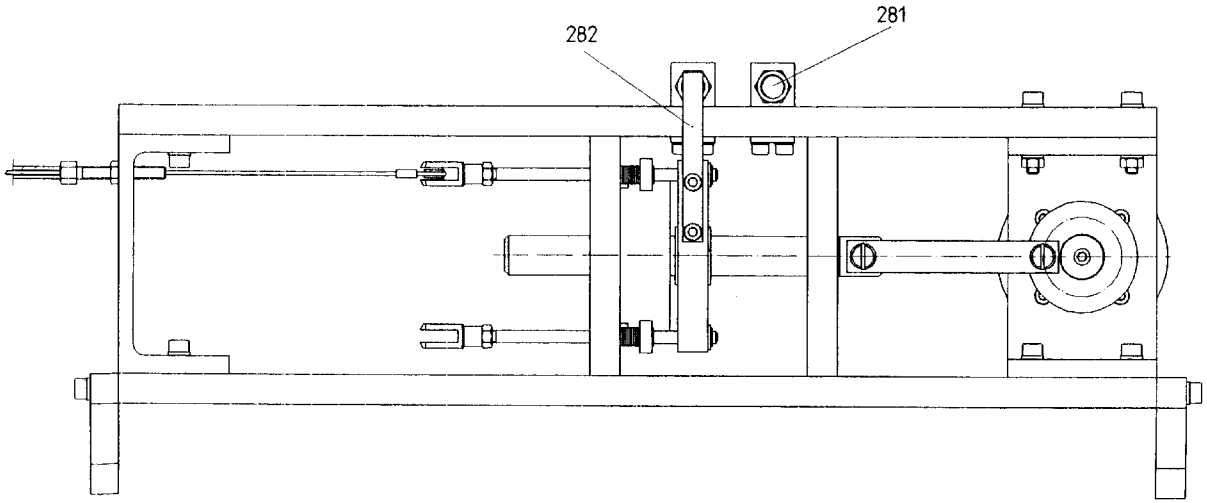
FIG. 51 is a fragmentary, plan view of the cable pull arrangement and showing the cable relaxed from its pulled position.

It will be appreciated that the cables 230 extend from each of the gripper mechanisms 215 and are rounded about the gripper plate 134. Referring to FIG. 49, an enlarged side view of the motor 257 of the grip arm drive 255 is shown. A position sensor 280 senses the position of the eccentric 258 for control of the motor 257. An arm 282 extends outwardly from the distribution plate 263 and is carried therewith. The arm 282 is variably positionable under a first sensor 281 or a second sensor 283.

In overview, the entire pin setter 1 is mounted in the pit section of a bowling alley. Pins 11 are set by the pin setter 1 in the proper position on the alley 14. After a ball 12 is rolled, pins may or may not be left standing. The ball and any struck pins roll or are hit down into the pin receiving section 3 whereupon the ball 12 is returned via a ball separating and returning mechanism and the pins 11 are processed through the pin receiving section 3 and carried upwardly on the elevator 5. Simultaneously, the pin setting mechanism 9 operates to lower the setting plate 133 and gripper plate 134 toward the alley 14. The gripper plate 134 comes into contact with any standing pins 11 and grips them and then the setting plate 133 and gripper plate 134 again move upwardly, carrying any pins 11 gripped in the gripper plate 134. The sweep arm 199 sweeps down the length of the alley to sweep any pins lying on the alley. The sweep arm 199 returns to the forward position, FIG. 1, and the setting plate and gripper plate 134 again return downwardly to set any pins in the gripper plate 134 back in the position they were taken from. Thereafter, the bowler makes the second roll of the ball, knocks down any pins he/she is able to and the sweep arm 199 sweeps all pins standing or knocked down from the alley. Any balls and pins received in the pin receiving section 3 are processed as previously described. Meanwhile, the pin setting mechanism 9 again descends and the gripper plate 134 extends all of the way to the surface of the alley 14. The gripper plate 134 first contacts the surface of the alley 14 and then moves upwardly as the setting plate 133 continues to move downwardly. Upon contact of the bottom of the pin receptacles 135 mounted in the setting plate 133 a new set of pins 11 is deposited on the surface of the alley 14 and the setting plate 133 and gripper plate 134 again move upwardly. As the setting plate 133 reaches its full upward position, the setting plate 133 again moves upwardly but this time, as controlled by the controller to a reload position so that the vertically aligned pin receptacles 135 touch each other and a pin 1I1 is dropped from the top receptacle into the lower receptacle.

Simultaneously, the elevator 5 continues to bring pins to the pin setting mechanism 9 via the transfer conveyor 7 and loads the pins in the upper reel 133.

A controller is used with the machine 1 and may be either a micro controller or a programmable logic controller which receives input signals from the various sensors mounted about the machine. The logic generated by the controller performs all the functions described above.

Although the above invention has been illustrated and described, it is not limited to the specific relationship of parts and functions except as set forth in the following claims.

It is to be understood that while certain forms of this invention have been illustrated and described, the invention is not limited to the specific forms or arrangement of parts described thereto, except insofar as such limitations are included in the following claims.

What is claimed and desired to be secured by Letters Patent is as follows:

1. A pinsetter machine comprising:

a) a frame means containing a pin accumulating layer including a reel mounted for horizontal rotation relative a vertical axis, said reel containing an array of pin, receptacles the quantity thereof corresponding to a quantity of pins to be set;

b) a pin setting layer mounted to said frame means and likewise containing an array of said pin receptacles in the same quantity as said pin receptacles of said reel;

c) a gripper layer mounted below said pin setting layer and having a plurality of pincher means for gripping pins when pins are left standing after a throw; and d) means of moving said pin setting layer and said gripper layer toward and away from a pin standing platform situated therebelow;

e) said receptacles devices each comprising a tubular structure readily removable from said accumulating layer and said pin setting layer and having a ring means movable up and down to said tubular structure, a catch arm and a trip arm linked together and biasing means in said tubular, structure said ring means cooperating with said catch arm, trip arm and biasing means to alternatingly catch and release pins from said accumulating layer through said pin setting layer.

2. In a bowling pin spotting machine of the type having a pin accumulating layer receiving pins from a conveyor and a substantially vertically reciprocal pin setting layer to which pins are transferred from said pin accumulating layer for setting upon an alley surface, the improvement comprising pin receptacles in said pin accumulating layer and said pin setting layer which correspond in pattern array and number, the pin receptacles each having a readily removable tubular structure with catch arms and trip arms connected by a linkage and a ring cooperating with said linkage to cause said pin receptacle to mechanically alternatingly catch and release pins, the release occurring upon upward movement of the respective pin receptacle relative to the respective pin accumulating layer or pin setting layer in which the pin receptacle is mounted, whereby said pin setting layer moves upwardly against said pin accumulating layer to cause pins held therein to drop into the pin setting layer, and said pin setting layer moves downwardly against the alley surface to cause pins held therein to drop onto the alley surface.

3. The improvement set forth in claim 2 wherein said pin receptacles are respectively mounted in the respective pin accumulating layer and pin setting layer by said, ring with said tubular structure movable vertically through said ring between a lower, pin retaining position and an upper pin release position.

* * * * *